US010968012B1

(12) United States Patent
Ward et al.

(10) Patent No.: US 10,968,012 B1
(45) Date of Patent: Apr. 6, 2021

(54) COLLAPSIBLE CONTAINERS

(71) Applicant: Amazon Technologies, Inc., Seattle, WA (US)

(72) Inventors: Suzanne Clark Ward, Santa Monica, CA (US); Jessica Fitzgerald, Moorestown, NJ (US); Jon P. Hassell, Atlanta, GA (US); Daniel Lowther, New Hope, PA (US); Kaushal Bharatkumar Mehta, Seattle, WA (US); Joshua D. Urban, Pasadena, CA (US)

(73) Assignee: Amazon Technologies, Inc., Seattle, WA (US)

( * ) Notice: Subject to any disclaimer, the term of this patent is extended or adjusted under 35 U.S.C. 154(b) by 98 days.

(21) Appl. No.: 16/192,682

(22) Filed: Nov. 15, 2018

Related U.S. Application Data

(63) Continuation-in-part of application No. 16/159,377, filed on Oct. 12, 2018.
(Continued)

(51) Int. Cl.
*B65D 25/20* (2006.01)
*B65D 21/08* (2006.01)
(Continued)

(52) U.S. Cl.
CPC ..... *B65D 21/086* (2013.01); *B65B 5/06* (2013.01); *B65B 31/04* (2013.01); *B65D 1/225* (2013.01); *B65D 21/0201* (2013.01); *B65D 21/0209* (2013.01); *B65D 25/20* (2013.01); *B65D 25/28* (2013.01); *B65D 81/2053* (2013.01)

(58) Field of Classification Search
CPC ..... B65D 21/086; B65D 21/0219; B65D 21/0222; B65D 21/0217; B65D 21/0209; B65D 21/0201; B65D 81/2061; B65D 81/2053; B65D 81/2046; B65D 25/20;
(Continued)

(56) References Cited

U.S. PATENT DOCUMENTS

2003/0106895 A1* 6/2003 Kalal ..... B65D 81/3893 220/9.2
2011/0272419 A1* 11/2011 Vanderberg ..... B65D 21/086 220/666
(Continued)

OTHER PUBLICATIONS

Wikipedia.com, "Unit load device," printed Oct. 11, 2018 (last edited Sep. 1, 2018), available at https://en.wikipedia.org/wiki/Unit_load_device, 11 pages.

*Primary Examiner* — Stephen J Castellano
(74) *Attorney, Agent, or Firm* — Athorus, PLLC

(57) ABSTRACT

Modular containers are formed in a collapsible fashion by flexible or rigid bodies and panels. A size of a modular container may be selected by inflating the modular container to a desired pressure or volume, coupling two or more bodies of the modular containers together, or mating the bodies of the modular containers to common bases or surfaces. The modular containers may be accessed via one or more openings in vertical or horizontal surfaces of such modular containers in order to load items into such modular containers or to unload the items therefrom. The modular containers may be assembled or collapsed manually or automatically, and transported to one or more locations separately or in stacks.

18 Claims, 26 Drawing Sheets

Related U.S. Application Data

(60) Provisional application No. 62/572,036, filed on Oct. 13, 2017, provisional application No. 62/590,245, filed on Nov. 22, 2017.

(51) Int. Cl.

| | |
|---|---|
| ***B65D 21/02*** | (2006.01) |
| ***B65D 1/22*** | (2006.01) |
| ***B65B 31/04*** | (2006.01) |
| ***B65D 25/28*** | (2006.01) |
| ***B65B 5/06*** | (2006.01) |
| ***B65D 81/20*** | (2006.01) |

(58) Field of Classification Search

CPC ..... B65D 1/225; B65D 25/28; B65B 31/04; B65B 5/06

USPC ..... 220/4.27; 206/508

See application file for complete search history.

(56) References Cited

U.S. PATENT DOCUMENTS

| | | | | |
|---|---|---|---|---|
| 2015/0088620 | A1* | 3/2015 | Wittek ..... | G06Q 30/0207 705/14.1 |
| 2016/0304244 | A1* | 10/2016 | Nankervis ..... | B65D 51/1644 |

* cited by examiner

UPPER FRAME AND LOWER FRAME CONFIGURED TO MATE WITH ONE ANOTHER

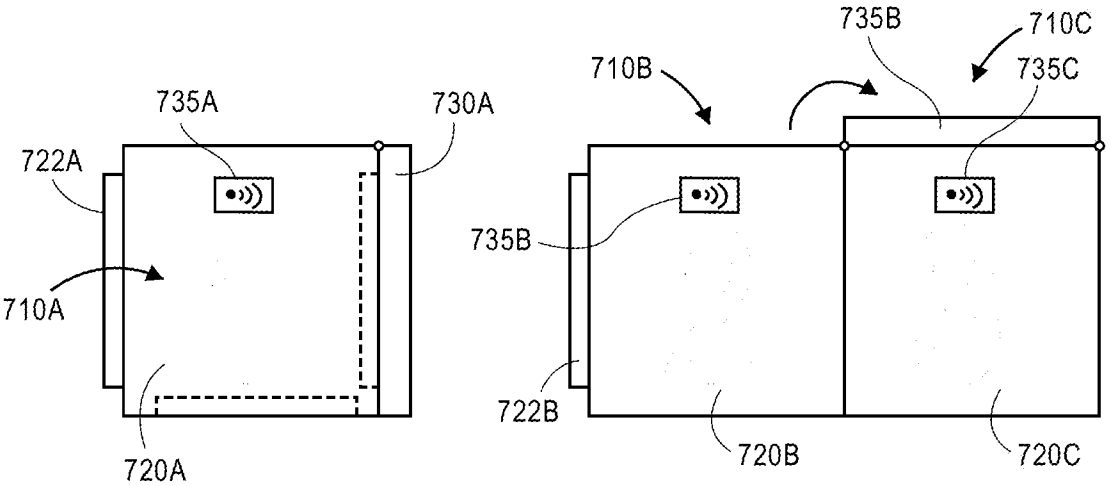
FIG. 7E
FIG. 7D
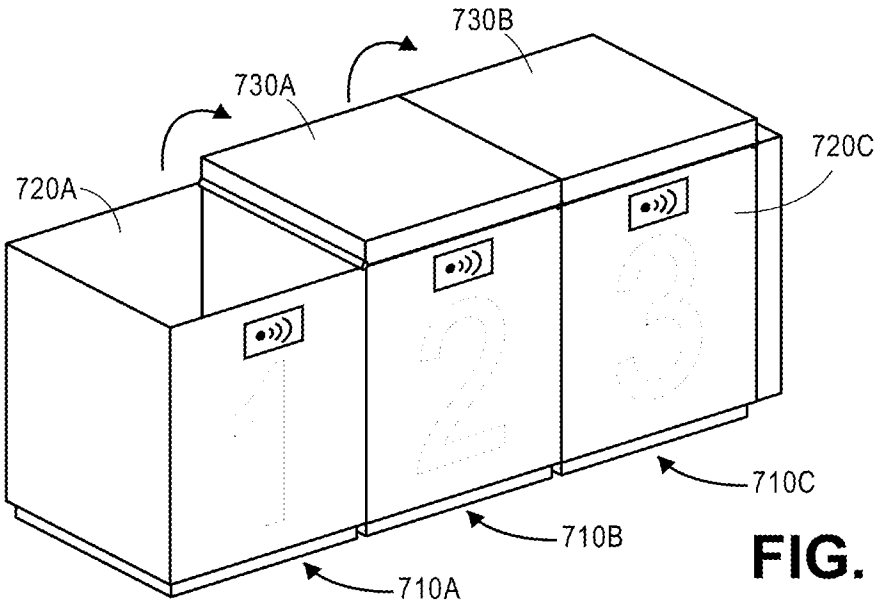
FIG. 7F

INDIVIDUAL SEALING PANELS FOR RESPECTIVE STACKS

SINGLE SEALING PANEL FOR ALL STACKS

COLLAPSIBLE CONTAINERS

CROSS-REFERENCE TO RELATED APPLICATIONS

This application claims priority to U.S. Patent Application No. 62/590,245, filed Nov. 22, 2017, the contents of which are incorporated by reference herein in their entirety.

This application is also a continuation-in-part of U.S. patent application Ser. No. 16/159,377, filed Oct. 12, 2018, which claims priority to U.S. Patent Application No. 62/572,036, filed Oct. 13, 2017. The contents of each of these applications are incorporated by reference herein in their entireties.

BACKGROUND

Contemporary online marketplaces are able to offer a wide variety of groups or types of items (including goods, services, information and/or media of any type or form) to customers who may be located in virtually any area of the globe, in any number of ways. Such items may be delivered in one or more containers to a fulfillment center or other facility operated by the online marketplace by one or more sellers, vendors, manufacturers or other sources. Upon arriving at the fulfillment center or other facility, the items may be unpacked or otherwise removed from such containers, and transported to one or more storage locations. When a customer places an order for one or more of the items, the items may be retrieved from a designated storage location and transported to a workstation where the item is to be packaged in one or more containers and prepared for delivery to the customer.

The processes of selecting containers and dunnage (e.g., paper, plastic, foam materials or "bubble wrap") to be included in such containers for a delivery of one or more items may be substantial drivers of the costs or time that are required in order to prepare and deliver such items. For example, while containers such as boxes, bags, tubes or envelopes are typically manufactured in nominal sizes, an item having dimensions that deviate from dimensions of nominally sized containers may require packing within a container having a number of voids or unused spaces, which are typically filled with dunnage. Moreover, selecting proper amounts and types of dunnage may create dilemmas for workers who are packing items within containers, as selecting excessive amounts of dunnage or overly heavy dunnage increases the weight of a container and may lead to unnecessary increases in cost, while selecting insufficient amounts of dunnage or inadequate types of dunnage may increase a risk of damage to an item during delivery. Furthermore, even when an item arrives at a destination safely, a customer or other recipient must dispose of a container in which the item arrived, along with any associated dunnage upon its arrival.

BRIEF DESCRIPTION OF THE DRAWINGS

FIGS. 7A through 7F are views of aspects of one modular container in accordance with embodiments of the present disclosure.

DETAILED DESCRIPTION

As is set forth in greater detail below, the present disclosure is directed to modular containers, which may be formed, assembled or otherwise erected from any suitable materials. In some embodiments, the containers may have varying sizes, shapes or volumes and may be combined with one another by stacking or aligning the containers in series or adjacent to one another. In some embodiments, the containers may be maintained at positive or negative (e.g., vacuum) pressures. In some embodiments, the containers may be collapsible in nature, and maintained in a compact, collapsed state when empty, or in an expanded state when filled with one or more items. In some embodiments, the containers may be configured for transportation singly or in combination with one or more other containers (e.g., in stacks), either manually or by one or more automated systems.

Figure 1A:
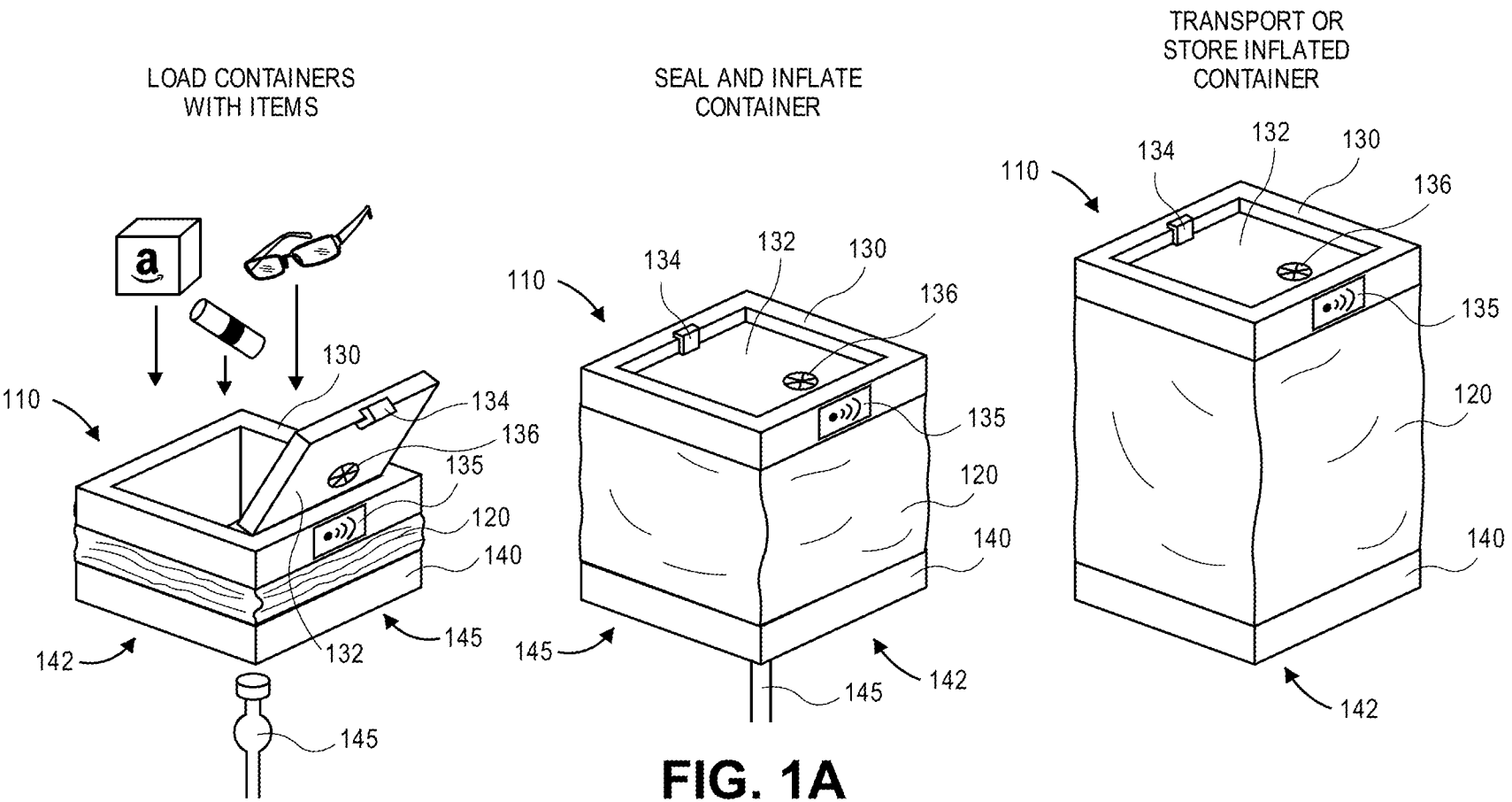
FIGS. 1A through 1E are views of aspects of one modular container in accordance with embodiments of the present disclosure.

Referring to FIGS. 1A through 1E, views of aspects of one modular container in accordance with embodiments of the present disclosure are shown. As is shown in FIG. 1A, a container 110 has a flexible body 120, a rigid upper frame 130 and a rigid lower frame 140. The flexible body 120 has an upper edge coupled to the rigid upper frame 130 and a lower edge coupled to the rigid lower frame 140. The container 110 may be charged with air or other fluids to cause the flexible body 120 to expand to a desired volume or internal pressure. The flexible body 120 may be formed from any flexible and suitably durable materials including but not limited to plastics, rubbers, woven or non-woven fabrics, natural or synthetic leathers or canvases, or other like materials which may be formed in one or more layers. The rigid upper frame 130 and the rigid lower frame 140 may be formed from any suitable materials such as metals, woods, plastics (e.g., injection molded plastics), rubbers or other materials. In some embodiments, the plastics from which the flexible body 120, the rigid upper frame 130 and/or the rigid lower frame 140 are formed may have any type, form or quality, and may be referenced by any identifier, such as a resin identification code number (e.g., an ASTM International Resin Identification Coding System number) ranging from one to seven.

Figure 1B:
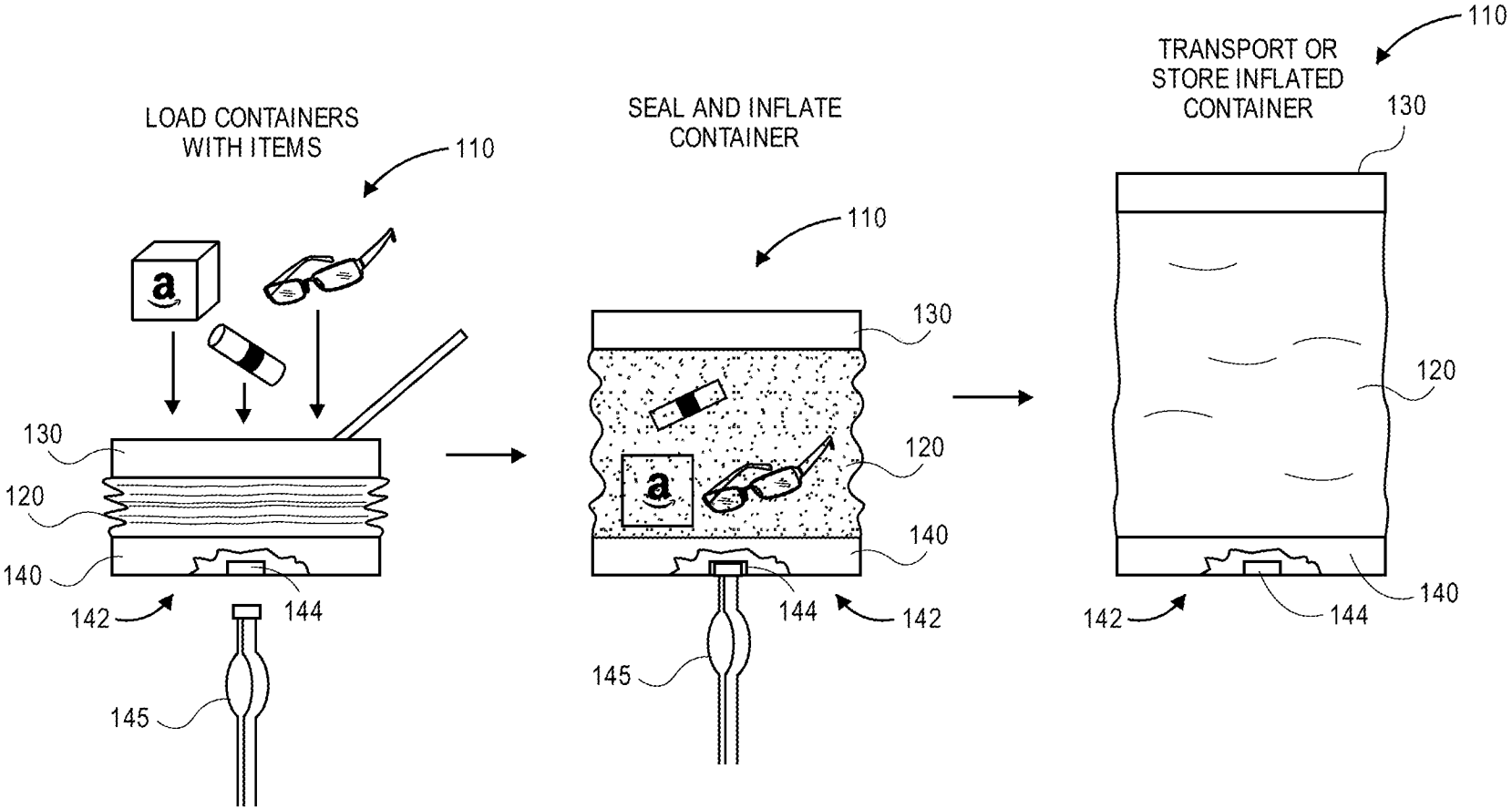
Figure 1C:
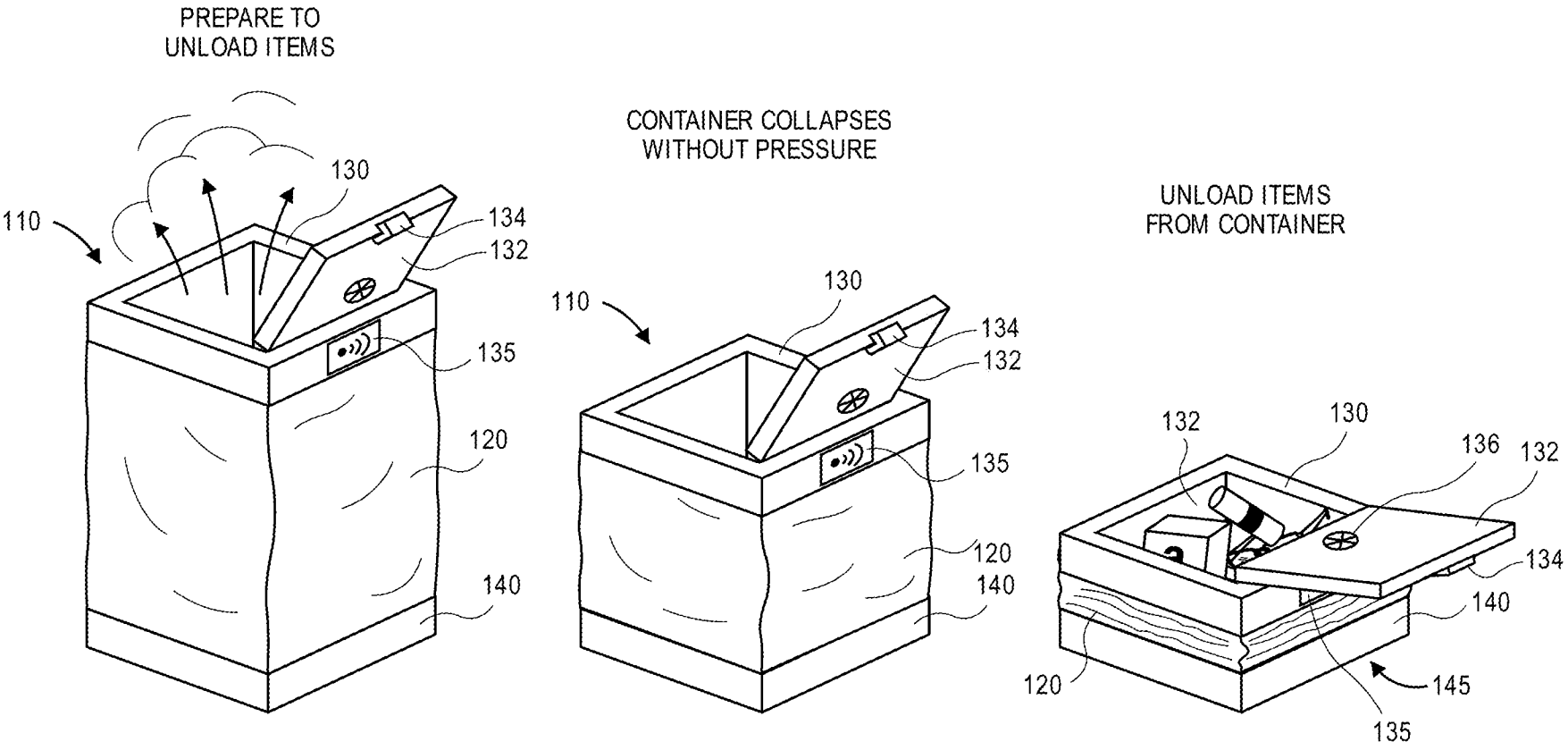
Figure 1D:
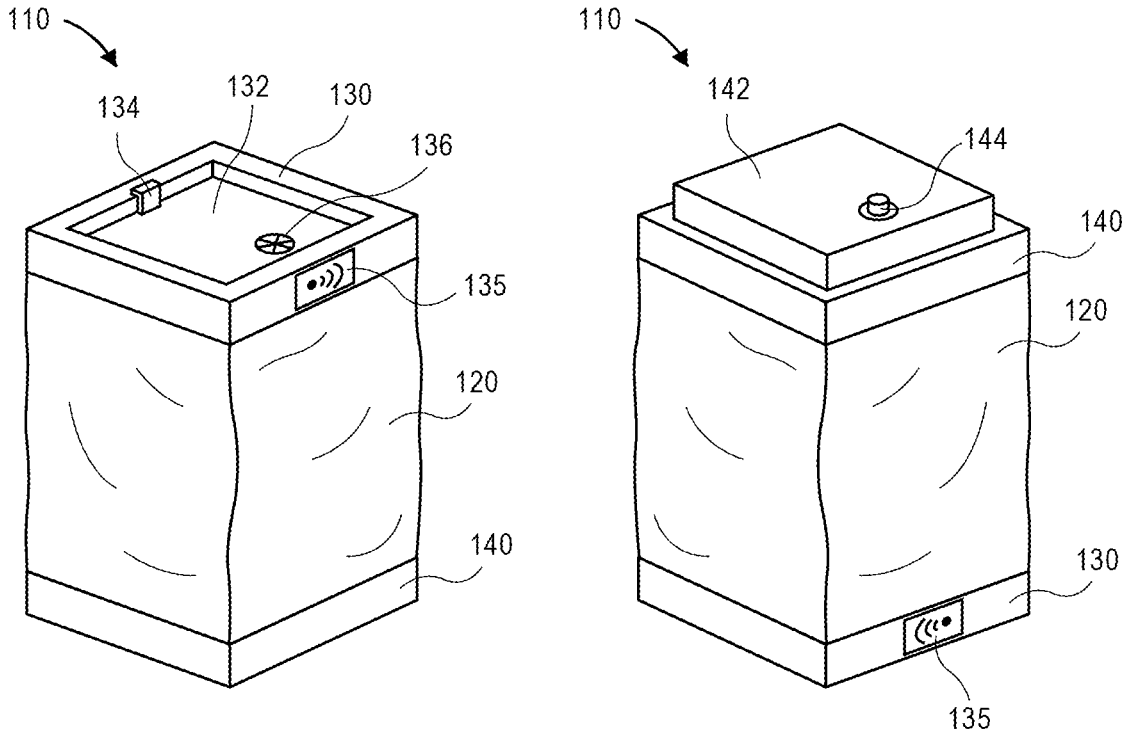
Figure 1E:
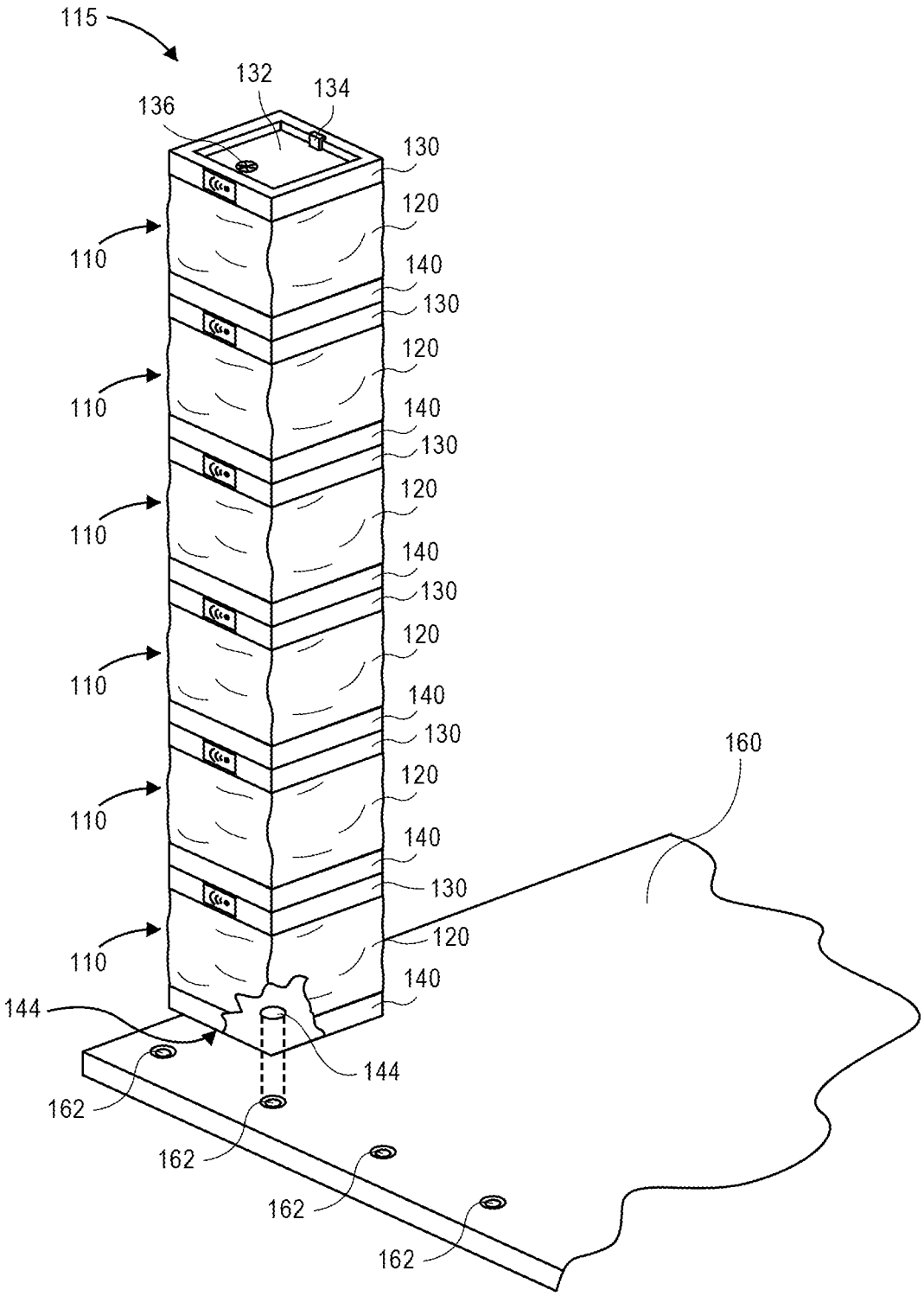

As is shown in FIG. 1A through 1E, the rigid upper frame 130 includes a hatch 132 (or lid, door or other cover) joined to the upper frame 130. The hatch 132 is configured to rotate about a hinge 134 between a closed position, e.g., in contact with a perimeter of an opening to the container 110, such as is shown in FIG. 1A, and an open position, such as is shown in FIG. 1E, thereby enabling one or more items to be inserted into a cavity for receiving items within the container 110 defined by the flexible body 120 and the rigid lower frame 140. The hatch 132 further includes a valve 136 for charging air into or discharging air from the cavity defined by the flexible body 120 and the rigid lower frame 140. The valve 136 includes a nozzle, a receiver or one or more other male or female features for mating with one or more other valves or systems, and may be operable by one or more manual or automatic actuators (not shown).

Additionally, the rigid upper frame 130 further includes a communications device 135 that may be configured to communicate with (e.g., transmit information or data to, or receive information or data from) one or more external computer devices or systems according to one or more wired means or wireless protocols or standards, e.g., Bluetooth®, Wireless Fidelity (or "Wi-Fi"), radiofrequency identification ("RFID"), or any other protocol or standard. For example, the communications device 135 may transmit or receive information or data regarding the contents of the container 110 to one or more external computer devices or systems, such as servers, handheld devices operated by one or more workers or autonomous mobile robots (e.g., within a fulfillment center or like facility), as well as origins or intended destinations for one or more of the contents of the container 110. Alternatively, or additionally, one or more external surfaces of the container 110 may include one or more alphanumeric characters, symbols or other markings thereon, including but not limited to one or more bar codes (e.g., one-dimensional bar codes or two-dimensional bar codes, such as "QR" codes). In some embodiments, one or more imaging devices or other sensors may capture data regarding such characters, symbols or markings, and identify information or data regarding the contents of the container 110, or one or more origins or intended destinations for one or more of the contents of the container 110, upon interpreting such characters, symbols or markings.

As is shown in FIGS. 1A and 1B, a volume of the cavity of the container 110 may be selected or defined based on a volume or pressure of air charged into the flexible body 120 by one or more external sources. For example, as is shown in FIGS. 1A and 1B, an external air source 145 may charge air into the container 110 by way of a valve 144 within a bottom section 142 of the rigid lower frame 140. The valve 144 includes a nozzle, a receiver or one or more other male or female features for mating with one or more other valves or systems, and may be operable by one or more manual or automatic actuators (not shown). In some embodiments, the valve 144 may be configured to mate with the valve 136, e.g., by one or more male or female features of the valve 144 and one or more female or male features of the valve 136.

For example, as is shown in FIGS. 1A and 1B, with the hatch 132 in an open position, one or more items may be inserted into the container 110. With the hatch 132 in a closed position, air may be charged into the container 110 by the external air source 145 until the container 110 is at a desired volume or pressure, e.g., a positive pressure with respect to atmospheric pressure external to the container 110. Because the rigid lower frame 140 and the rigid upper frame 130 have substantially equal areas and constant cross-sections, charging air into the container 110 causes a height of the container 110 to vary. As is also shown in FIGS. 1A and 1B, when the container 110 is at a desired height, the charging of air into the container 110 may be secured. Alternatively, air may be discharged or released from the container 110 by way of the valve 136 or the valve 144, as desired.

As is shown in FIG. 1C, when unloading the items within the container 110 is desired, the hatch 132 may be placed in an open position, thereby relieving any positive pressure within the container 110, and causing the flexible body 120 to collapse. With the hatch 132 in the open position, and the flexible body 120 collapsed, the one or more items therein may be readily unloaded. Subsequently, the container 110 may be reused by returning one or more items to the container, such as is shown in FIGS. 1A and 1B, and charging the container 110 full of air again, e.g., by the external air source 145.

As is shown in FIG. 1D, the rigid lower frame 140 and the rigid upper frame 130 are sized, shaped or otherwise configured to mate with one another. For example, as is shown in FIG. 1D, the bottom section 142 has an external size, area or cross-section corresponding to an interior size, area or cross-section of the rigid upper frame 130. Where the container 110 is so configured, two or more of the containers 110 may be stacked atop one another.

As is shown in FIG. 1E, a stack 115 of six of the containers 110 is shown as being installed on a flatbed surface 160 of a trailer or other vehicle (or another surface). In such embodiments, the valve 136 of the rigid upper frame 130 of one container 110 may be aligned with the valve 144 of the rigid lower frame 140 of another container 110, thereby enabling the containers 110 to be mated together and maintained at a selected pressure or at a selected volume, e.g., by charging air to the containers 110 from a single source, or discharging or reliving air from the containers 110 at a single valve. For example, as is shown in FIG. 1E, the valve 144 of a lowermost one of the containers 110 in the stack (or column) 115 of the containers 110 is installed on one of a plurality of valves 162 aligned in the flatbed surface 160. The containers 110 of the stack 115 are in fluid communication with one another and may be maintained at a selected volume or pressure by charging air into the containers 110 or relieving pressure from the containers 110 by way of the one of the plurality of valves 162, or by otherwise manipulating the valves 162. Moreover, the containers 110 in the stack 115 may be transported from one location to one or more other locations by way of the flatbed surface 160, e.g., by one or more vehicles.

Figure 2A:
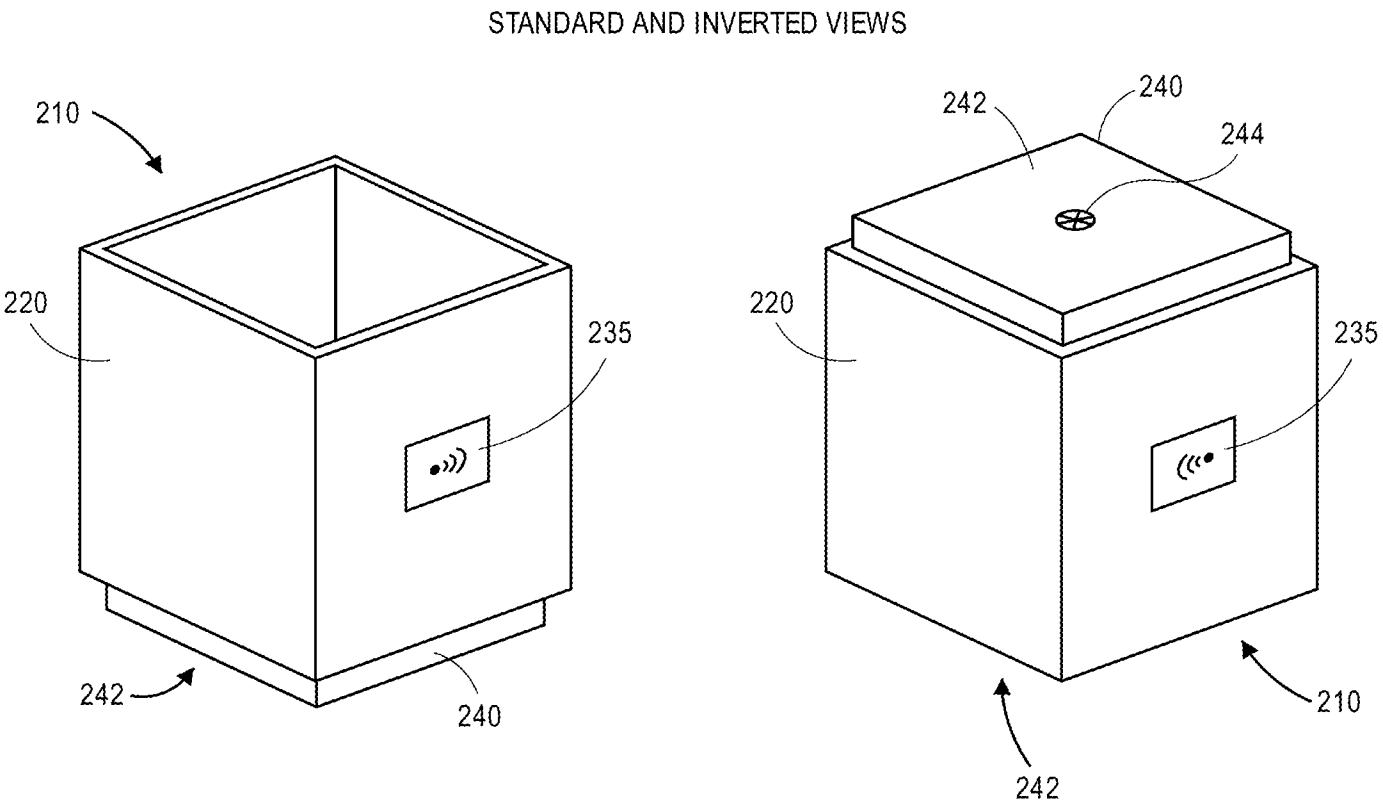
FIGS. 2A and 2B are views of aspects of one modular container in accordance with embodiments of the present disclosure.
Figure 2B:
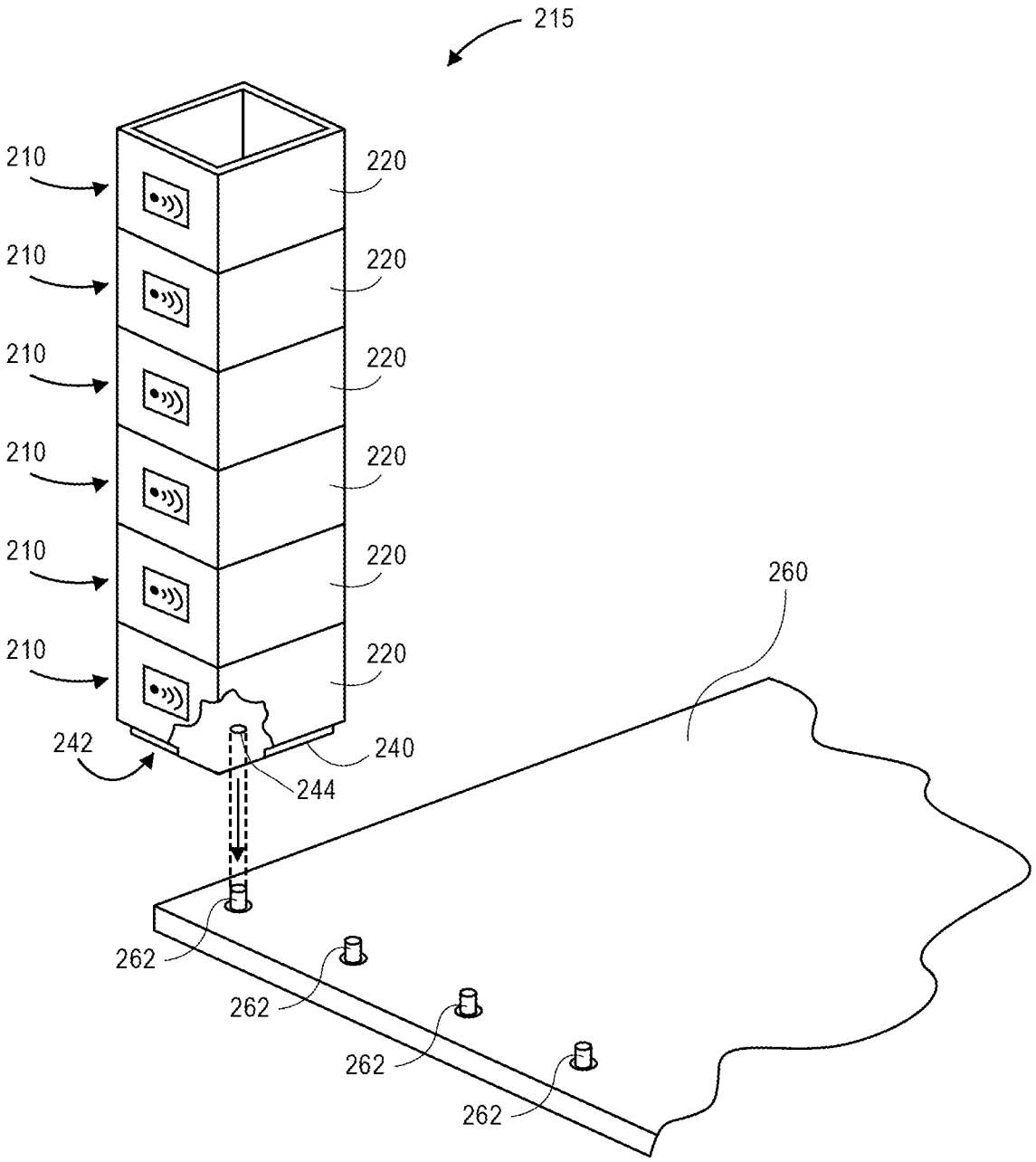

One or more of the modular containers disclosed herein may also be maintained at negative (e.g., vacuum) pressures. Referring to FIGS. 2A and 2B, views of aspects of one modular container in accordance with embodiments of the present disclosure are shown. Except where otherwise noted, reference numerals preceded by the number "2" in FIGS. 2A and 2B refer to elements that are similar to elements having reference numerals preceded by the number "1" shown in FIGS. 1A through 1E.

Referring to FIGS. 2A and 2B, standard and inverted views of a container 210 having a rigid body 220 and a rigid lower frame 240 are shown. Unlike the container 110 of FIGS. 1A through 1E, the container 210 is not collapsible in nature. Rather, the rigid body 220 defines an internal cavity having a substantially rectangular cross-section and includes a communications device 235 disposed on an outer surface. The rigid body 220 and the rigid lower frame 240 may be formed from any sufficiently durable materials such as metals, woods, plastics (e.g., injection molded plastics), rubbers or other materials that may be selected to withstand pressure differentials between a desired internal pressure of the container 210 and external (e.g., atmospheric) pressures in an environment where the container 210 is stored. The rigid body 220 and the rigid lower frame 240 may also be selected to withstand stresses in tension or compression, as necessary, e.g., where one or more of the containers 210 are stacked atop one another. As is shown in FIG. 2B, the rigid lower frame 240 further includes a bottom 242 having a valve 244 disposed therein.

As is shown in FIG. 2B, where internal dimensions of a cross-section of the container 210 correspond to external dimensions of a cross-section of the bottom 242, a plurality of the containers 210 may be placed atop one another in a stack (or column) 215, with the bottom 242 of one container 210 forming a barrier with an internal cavity of another container 210.

For example, as is shown in FIG. 2B, the stack 215 of the containers 210 is shown as being installed on one of a plurality of valves 262 aligned in a flatbed surface 260. One or more of the containers 210 of the stack 215 may be maintained at a selected pressure by charging air into the containers 210 or relieving pressure from the containers 210 by way of the one of the plurality of valves 262, or by otherwise manipulating the valves 262, to charge air into or draw air from the containers 210 by way of the valve 244 of a lowermost one of the containers 210 in the stack 215. In some embodiments, the containers 210 in the stack 215 may be drawn together by negative (e.g., vacuum) conditions, e.g., by withdrawing air from the containers 210 by way of the valves 244 and/or the valve 262. Moreover, the containers 210 in the stack 215 may be transported from one location to one or more other locations by way of the flatbed surface 260, e.g., by one or more vehicles. In some embodiments, an uppermost one of the containers 210 in the stack 215 may be closed and/or covered by an upper frame (not shown) having one or more sections corresponding to the cross-section of the container 210, in order to enable each of the containers 210 in the stack 215 to be maintained at a common, desired pressure. In some embodiments, the uppermost one of the containers 210 in the stack 215 may be closed and/or covered by another of the rigid lower frames 240.

One or more of the modular containers of the present disclosure may include one or more covers or bases having latches or other systems for sealing the containers and for coupling containers to one another. Referring to FIGS. 3A through 3E, views of aspects of one modular container in accordance with embodiments of the present disclosure are shown. Except where otherwise noted, reference numerals preceded by the number "3" in FIGS. 3A through 3E refer to elements that are similar to elements having reference numerals preceded by the number "2" in FIGS. 2A and 2B or by the number "1" shown in FIGS. 1A through 1E.

Figure 3C:
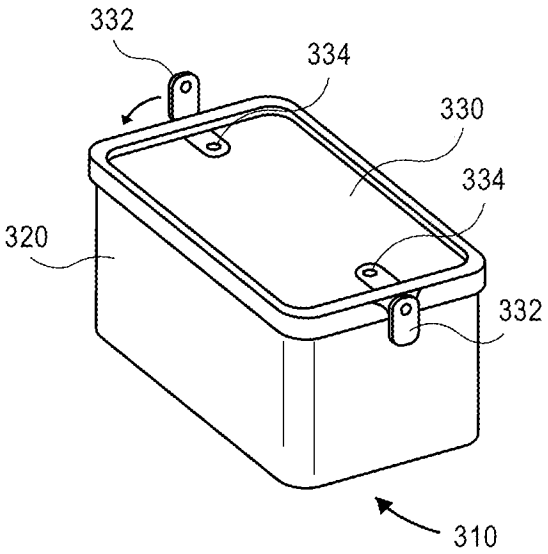
FIGS. 3A through 3E are views of aspects of one modular container in accordance with embodiments of the present disclosure.
Figure 3B:
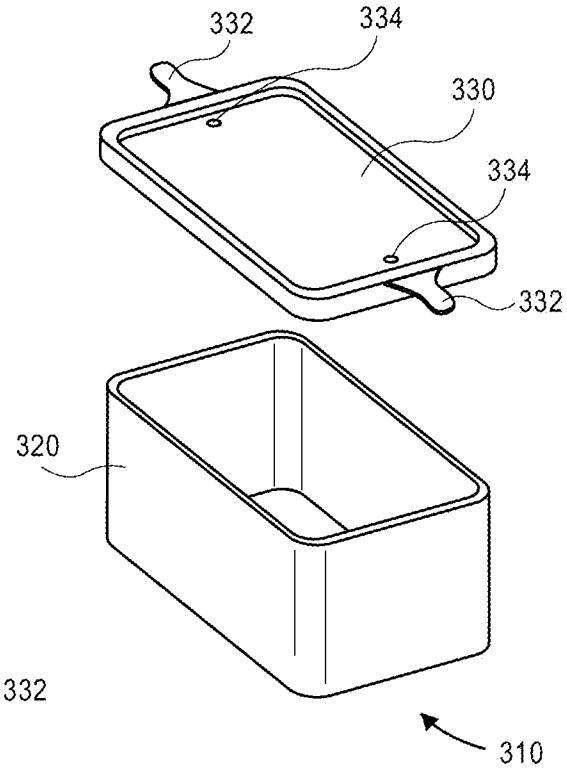
Figure 3A:
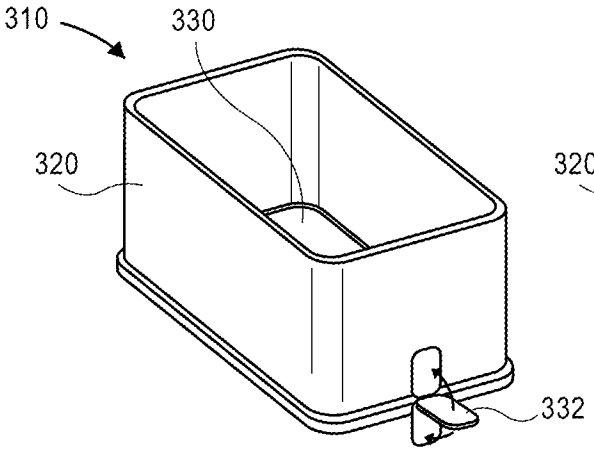

As is shown in FIGS. 3A through 3C, a container 310 includes a rigid (or semi-rigid) body 320 and a sealing panel (or base) 330. The body 320 and the sealing panel 330 may be formed from any suitable materials, e.g., metals, woods, plastics (e.g., injection molded plastics), rubbers or other materials. In some embodiments, the body 320 and the sealing panel 330 may be formed from the same materials. In some embodiments, the body 320 and the sealing panel 330 may be formed from different materials.

As is shown in FIG. 3B, the sealing panel 330 may mate with the body 320 in any manner, e.g., by an interference fit connection between a perimeter of the sealing panel 330 and an inner perimeter of the body 320, which may be symmetrical in nature, such that the sealing panel 330 may be applied to an upper edge of the body 320 or to a lower edge of the body 320.

As is shown in FIGS. 3A through 3C, the sealing panel 330 further includes one or more latches 332 for securing the sealing panel 330 to the container 310, e.g., within or about a perimeter of an upper or a lower edge of the body 320. In some embodiments, the sealing panels 330 may further include one or more ventilation holes 334 or channels that enable air flow into or out of the container 310 when the sealing panel 330 is applied thereon. The latches 332 may be configured to swing or rotate about hinges on edges of the sealing panel 330 between positions in which the latches 332 rest on or seal the ventilation holes 334 on the sealing panels 330 and positions in which the latches 332 mate with outer surfaces of the body 320. The sealing panel 330 may also have two sides that are each configured to mate with the body 320 in a different manner. For example, as is shown in FIG. 3A, the sealing panel 330 may include a ledge or ridge about a perimeter that enables the sealing panel 330 to surround an outer perimeter at a top end or a bottom end of the body 320 and receive the outer perimeter of the body 320 therein. As is shown in FIGS. 3B and 3C, the sealing panel 330 may also include a cavity that may also receive an outer perimeter at a top end or a bottom end of the body 320 therein.

Figure 3E:
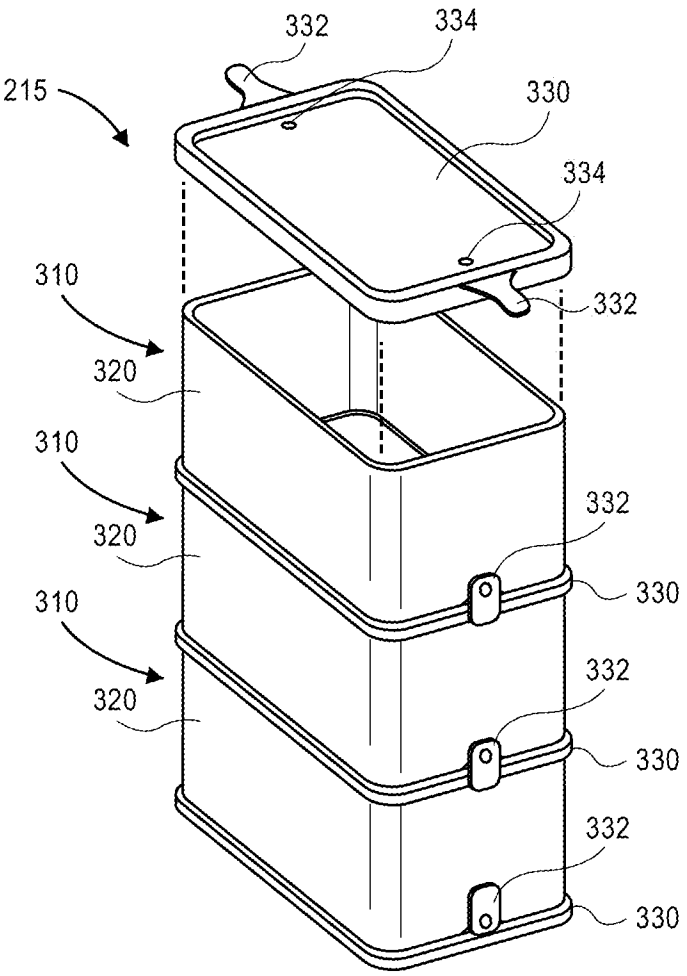
Figure 3D:
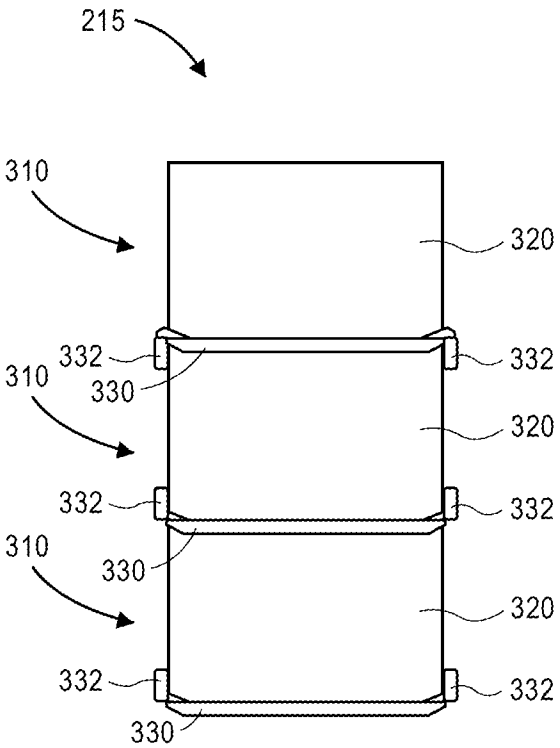

As is shown in FIGS. 3D and 3E, three of the containers 310 are shown in a stack (or column) 315. A lowest or bottom-most container 310 includes a sealing panel 330 at a bottom end of the body 320. As is discussed above, the sealing panel 330 includes a ledge or ridge that surrounds an outer perimeter of the bottom end of the body 320 and is secured in place by one or more latches 332. Immediately above the lowest or bottom-most container 310 are two other containers 310, each of which also includes a sealing panel 330 having a ledge or ridge that surrounds an outer perimeter of a bottom end of a body 320 of one of the containers 310 and is also inserted into an inner perimeter of an upper end of a body of one of the containers 310. The sealing panels 330 may be engaged therein, e.g., in an airtight manner and secured in place by the one or more latches 332.

One or more of the modular containers of the present disclosure may be assembled or disassembled on an as-needed basis, e.g., when one or more items are to be stored or transported within such containers, or when such containers are not required for storage or delivery, and may themselves be stored or delivered. Referring to FIGS. 4A through 4E, views of aspects of one modular container in accordance with embodiments of the present disclosure are shown. Except where otherwise noted, reference numerals preceded by the number "4" in FIGS. 4A through 4E refer to elements that are similar to elements having reference numerals preceded by the number "3" in FIGS. 3A through 3E, by the number "2" in FIGS. 2A and 2B or by the number "1" shown in FIGS. 1A through 1E.

Figure 4B:
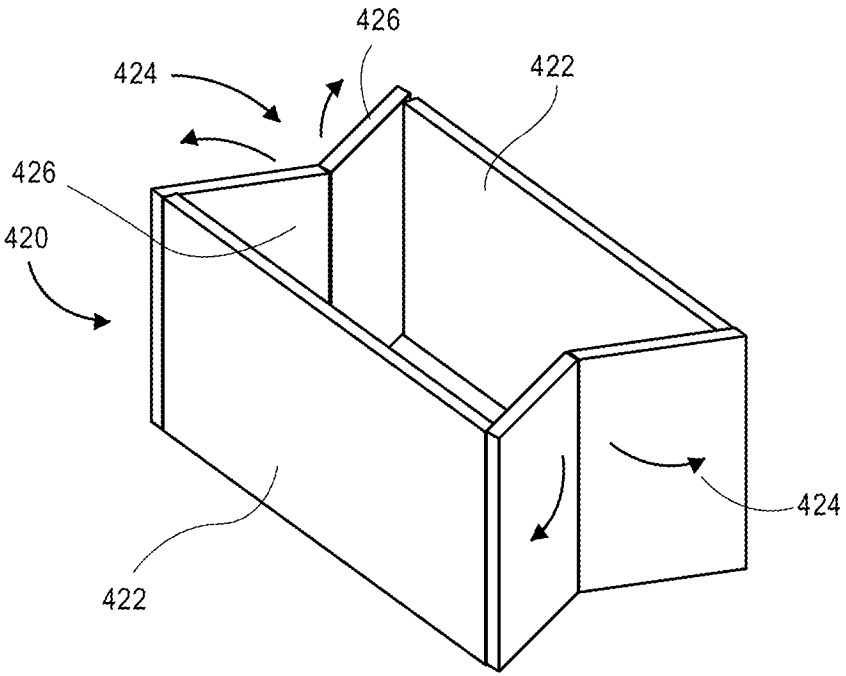
FIGS. 4A through 4E are views of aspects of one modular container in accordance with embodiments of the present disclosure.
Figure 4A:
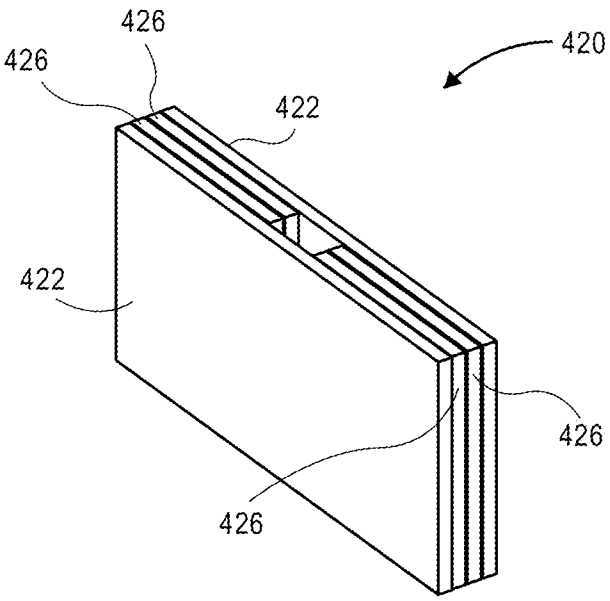
Figure 4C:
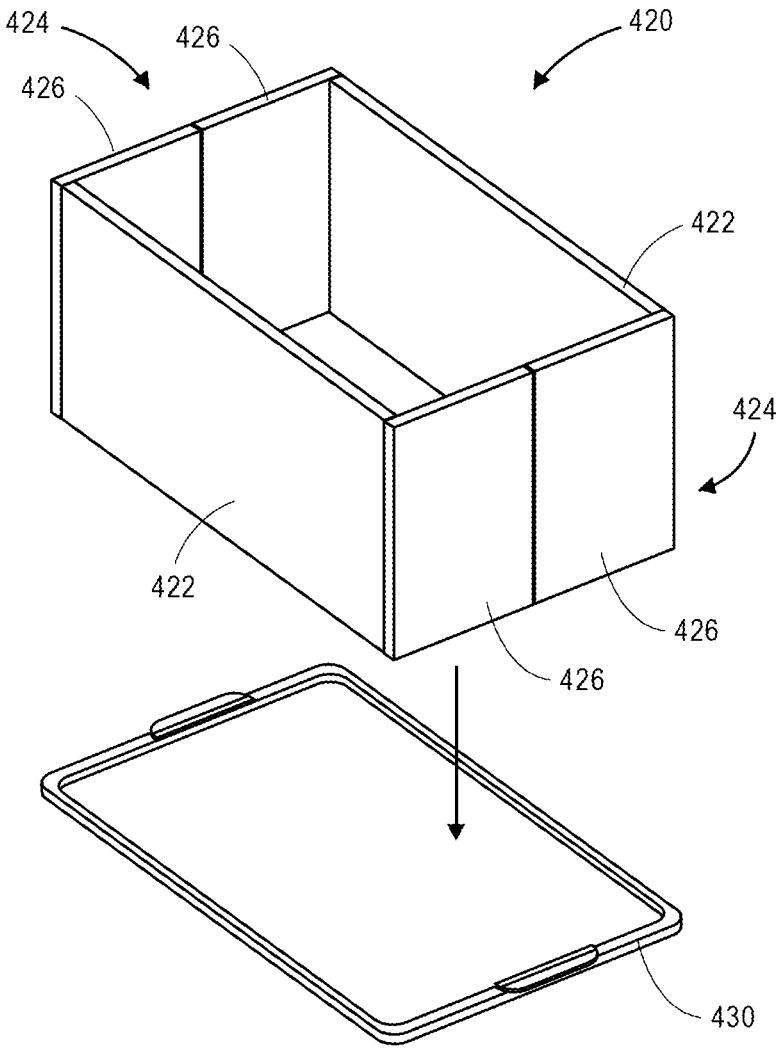

As is shown in FIGS. 4A through 4C, a foldable body 420 includes a pair of long sides 422 and a pair of short sides 424 that may be mated with a sealing panel (or base) 430 to form a container 410. The foldable body 420 is a single, contiguous unit, with each of the long sides 422 having ends joined to each of the short sides 424 at edges defined by hinges. Each of the pair of long sides 422 and each of the pair of short sides 424 has a common height. The long sides 422 are substantially rigid in nature, e.g., not broken or divided by one or more creases or scores, and intended to remain straight and substantially rigid at all times. The short sides 424 each include a single hinge aligned parallel to the respective edges of the short sides 424 and the long sides 422. The hinges of the short sides 424 are provided substantially centrally with respect to the container 410, e.g., defined by a crease or a score, such that the hinges effectively form two adjacent sections or panels 426 within each of the short sides 424. The long sides 422 and the short sides 424 may be formed from any suitable materials, e.g., metals, woods, plastics (e.g., injection molded plastics), rubbers or other materials. The hinges at corners joining the long sides 422 with the short sides 424, and the hinges defining the sections or panels 426 within the short sides 424, may each be defined as discrete parts within the foldable body 420 or, alternatively, one or more indentations, reductions in thickness, creases or scores, or any other alterations or modifications by which the long sides 422 may be joined to the short sides 424, or alterations or modifications to the short sides 424 that may enable the short sides 424 to be folded inwardly or outwardly with respect to one another. In some embodiments, the long sides 422 and the short sides 424 may have the same length, such that neither side is "long" nor "short" with respect to any other side.

As is shown in FIG. 4B, the sections or panels 426 of the short sides 424 may each be folded inwardly at corners and by their respective hinges, to collapse the foldable body 420 into a single, flattened unit. Alternatively, as is shown in FIGS. 4B and 4C, the sections or panels 426 of the short sides 424 may be folded outwardly at corners of the foldable body 420 and by their respective hinges to form the foldable body 420 into an expanded unit having a substantially rectangular cross-section with a lower edge that may be pressed onto the sealing panel 430 (e.g., within one or more ledges or ridges) to form the container 410.

Figure 4D:
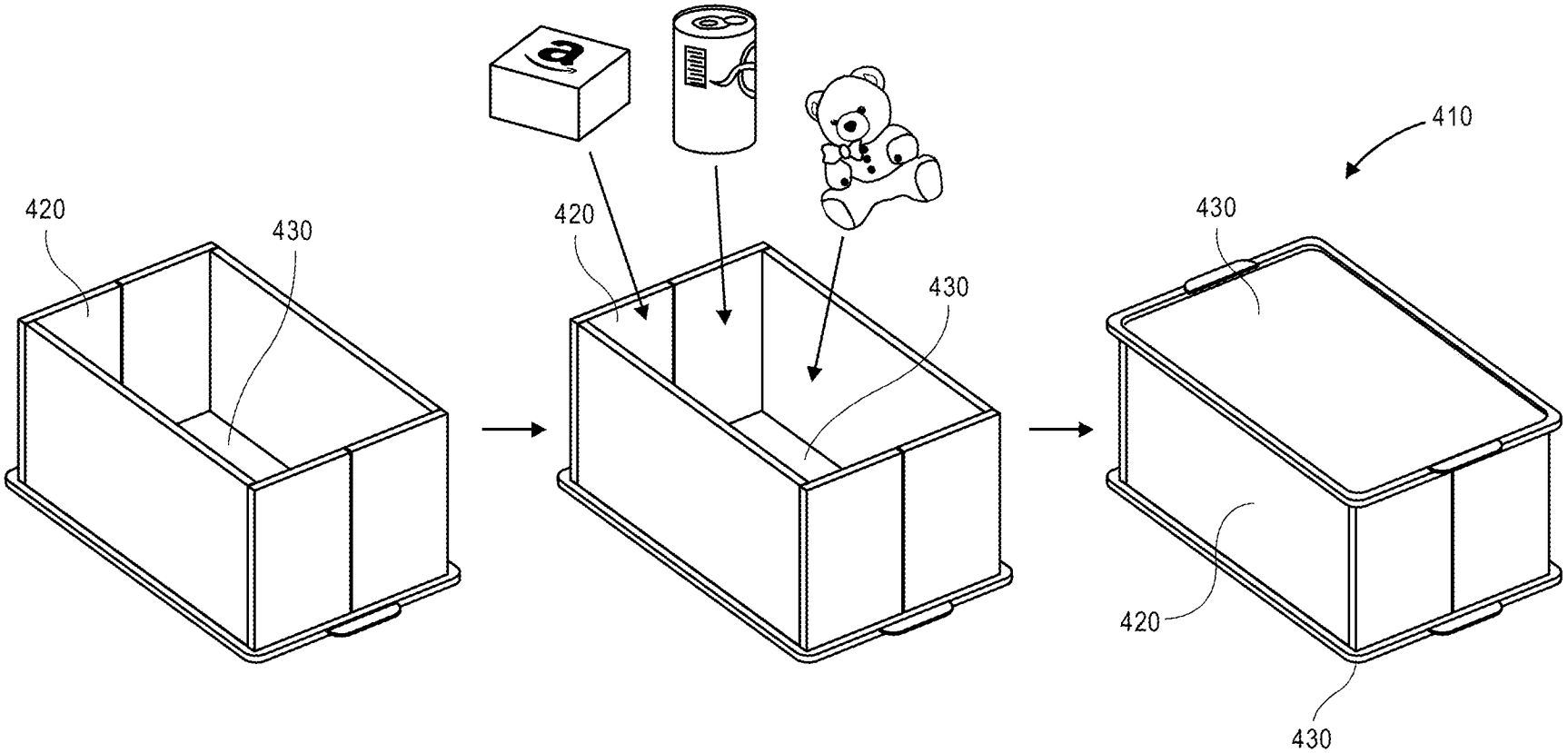

As is shown in FIG. 4D, with the container 410 having been formed by pressing the foldable body 420 into one of the sealing panels 430, a plurality of items may be deposited into the container 410. After the one or more items have been deposited into the container 410, another sealing panel 430 may be applied to an upper edge of the foldable body 420 to seal the container 410 with the items therein. In some embodiments, where the sealing panel 430 has surfaces corresponding to the lower edge and the upper edge of the foldable body 420, a plurality of the containers 410 may be formed by stacking one or more foldable bodies 420 having sealing panels 430 thereon atop one another.

Figure 4E:
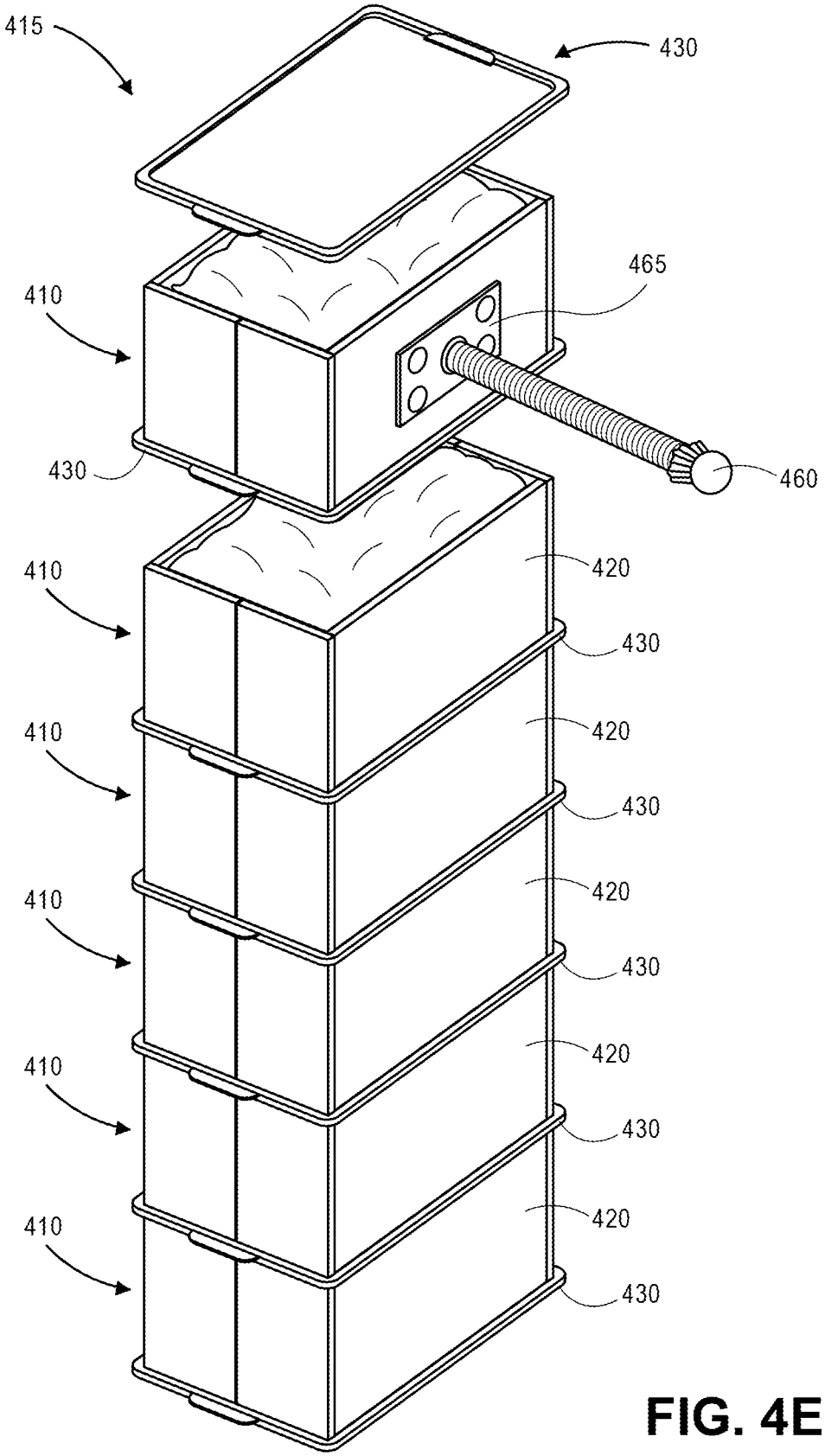

As is shown in FIG. 4E, one or more containers 410 may be placed onto a stack (or column) 415 or removed from the stack 415 manually or automatically, such as by a robotic system (e.g., arm) 460 having a head 465 configured to contact and engage with one or more of the containers 410 by suction or mechanical interaction. With the head 465 engaged with one or more of the containers 410, the robotic system 460 may release the one or more containers 410 from the stack 415, e.g., by elevating the one or more containers 410, repositioning the robotic system 460, and depositing the one or more containers 410 in another location.

Figure 5A:
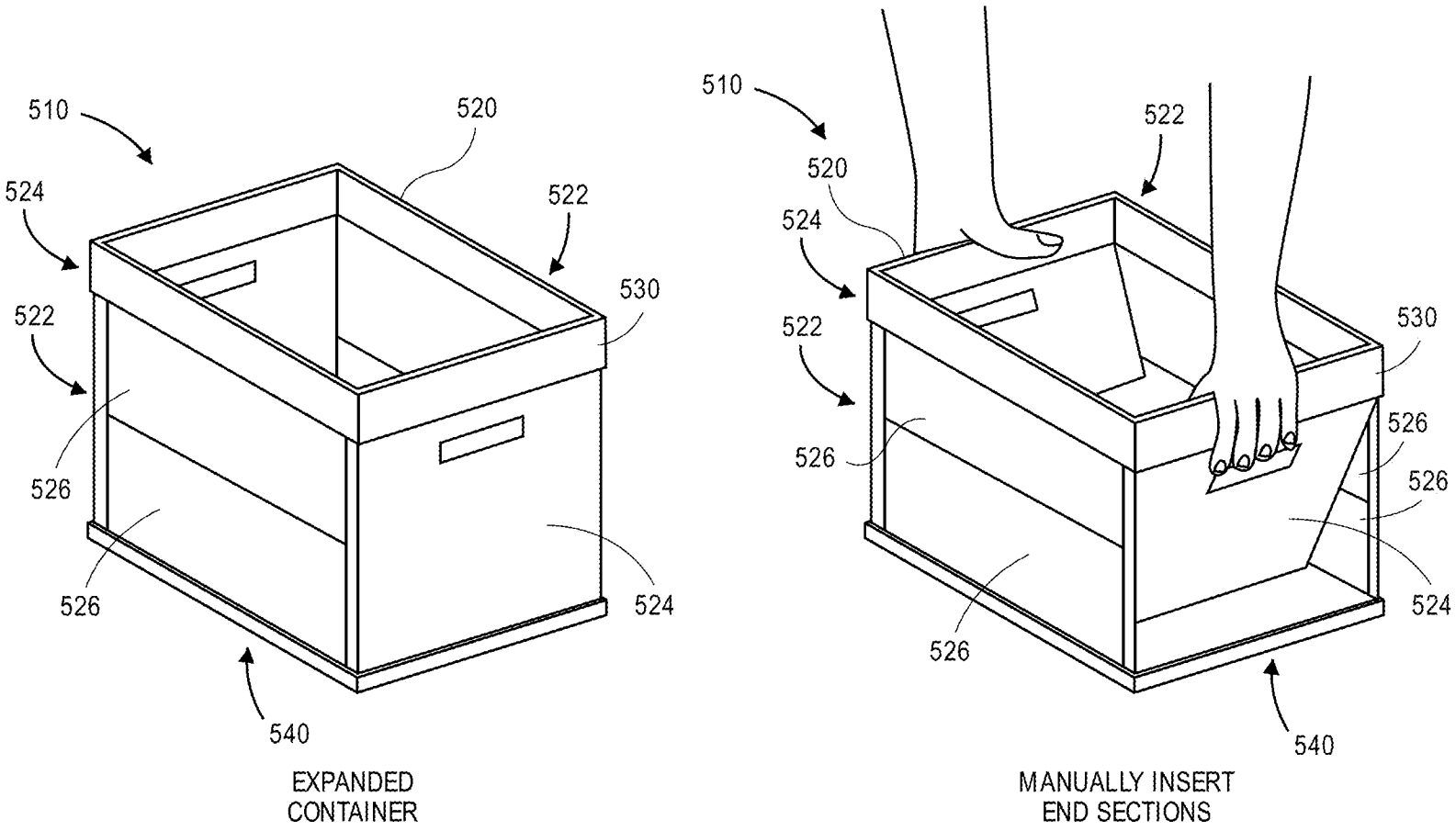
FIGS. 5A and 5B are views of aspects of one modular container in accordance with embodiments of the present disclosure.
Figure 5B:
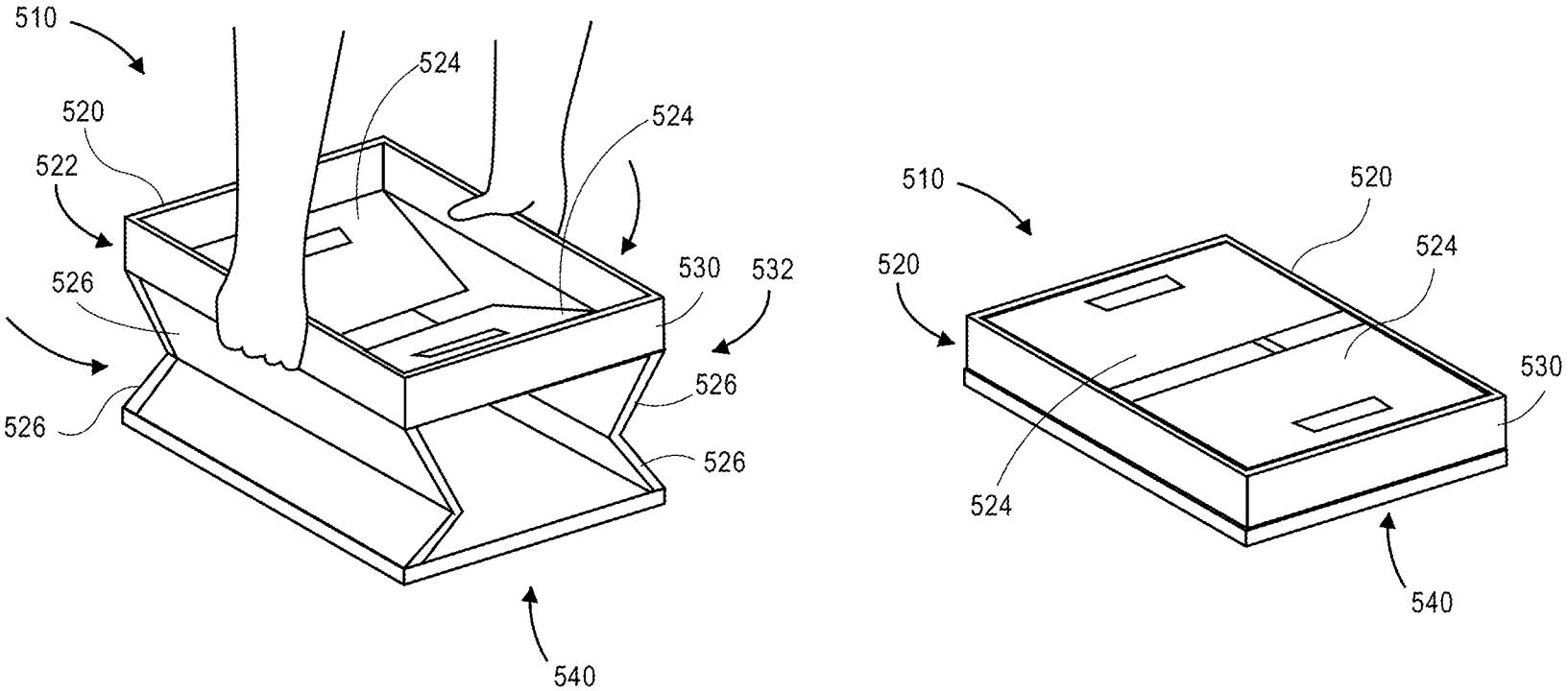

Modular containers may have two or more sets of adjustable or movable sides in accordance with the present disclosure. Referring to FIGS. 5A and 5B, views of aspects of one modular container in accordance with embodiments of the present disclosure are shown. Except where otherwise noted, reference numerals preceded by the number "5" in FIGS. 5A and 5B refer to elements that are similar to elements having reference numerals preceded by the number "4" in FIGS. 4A through 4E, by the number "3" in FIGS. 3A through 3E, by the number "2" in FIGS. 2A and 2B or by the number "1" shown in FIGS. 1A through 1E.

As is shown in FIG. 5A, a modular container 510 has a foldable body 520 having a rigid upper frame 530 at an upper edge of the foldable body 520 and a rigid lower frame 540 having a sealing panel (or base) at a lower edge of the foldable body 520. In some embodiments, the rigid upper frame 530 may be closed or sealed by a sealing panel (or base, not shown) which may be applied about the rigid upper frame 530.

The foldable body 520 includes a pair of long sides 522 and a pair of short sides 524 that, along with the rigid lower frame 540, define a cavity for receiving one or more items therein. The long sides 522 and the short sides 524 may include one or more openings, slots, handles or other features enabling the container 510 to be manipulated or transported manually or by one or more automated systems.

Each of the long sides 522 includes a pair of panels 526 separated by a hinge running parallel to upper edges and lower edges of the foldable body 520. The hinges of the long sides 522 enable the long sides 522 to be effectively divided in half by folding the panels 526 of the long sides 522 about their respective hinges in an inward manner, e.g., into the cavity defined by the foldable body 520. Additionally, each of the short sides 524 includes a hinge running along an upper edge of the foldable body 520, e.g., adjacent the rigid upper frame 530, thereby enabling the short sides 524 to rotate about their respective hinges in an inward manner, e.g., into the cavity defined by the foldable body 520.

As is shown in FIG. 5B, the container 510 of FIG. 5A may be collapsed by applying manual pressure to the respective short sides 524, thereby causing the short sides 524 to be folded inward into the cavity defined by the foldable body 520, e.g., by approximately ninety degrees, until the short sides 524 are aligned substantially horizontally and parallel to the rigid lower frame 540. With the short sides 524 swung into the cavity defined by the foldable body 520, the container 510 may be further collapsed by folding the panels 526 of the long sides 522 inward into the cavity defined by the foldable body 520, thereby causing the rigid upper frame 530 to descend toward the rigid lower frame 540. As is further shown in FIG. 5B, upon folding the panels 526 of the long sides 522 and the short sides 524 about their respective hinges and in the inward manner, the height of the container 510 in the collapsed form is less than half of the height of the container 510 in the expanded form shown in FIG. 5A, and is defined by the respective heights of the rigid upper frame 530 and the rigid lower frame 540.

Figure 6B:
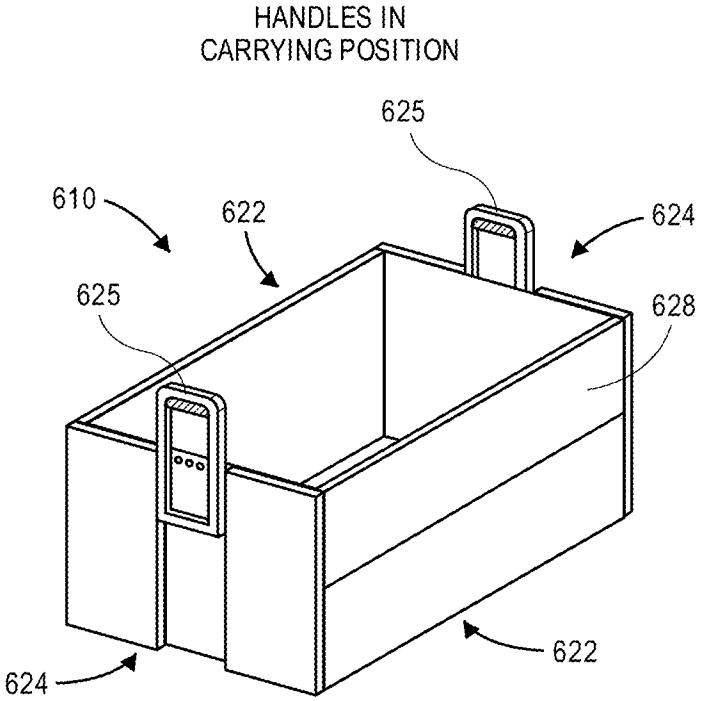
FIGS. 6A through 6C are views of aspects of one modular container in accordance with embodiments of the present disclosure.
Figure 6A:
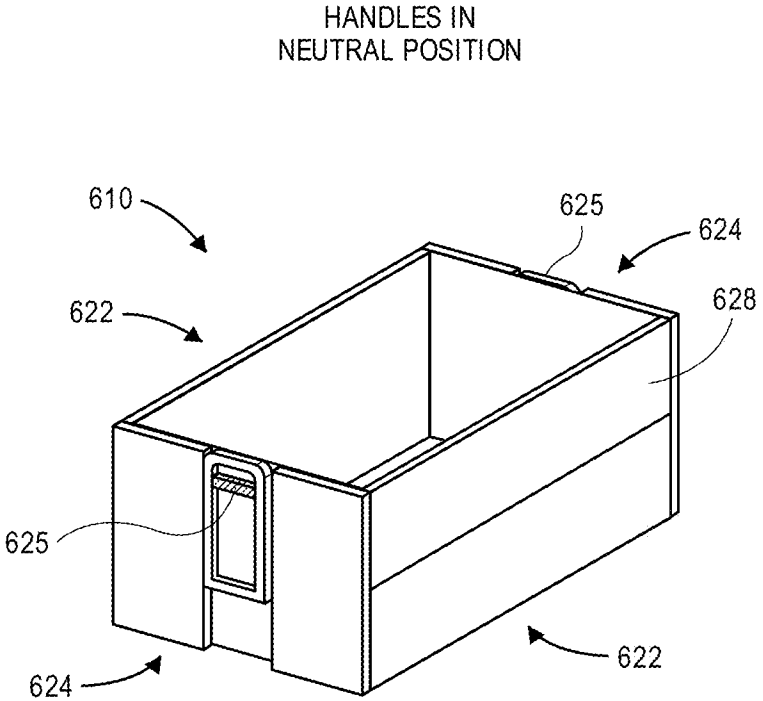
Figure 6C:
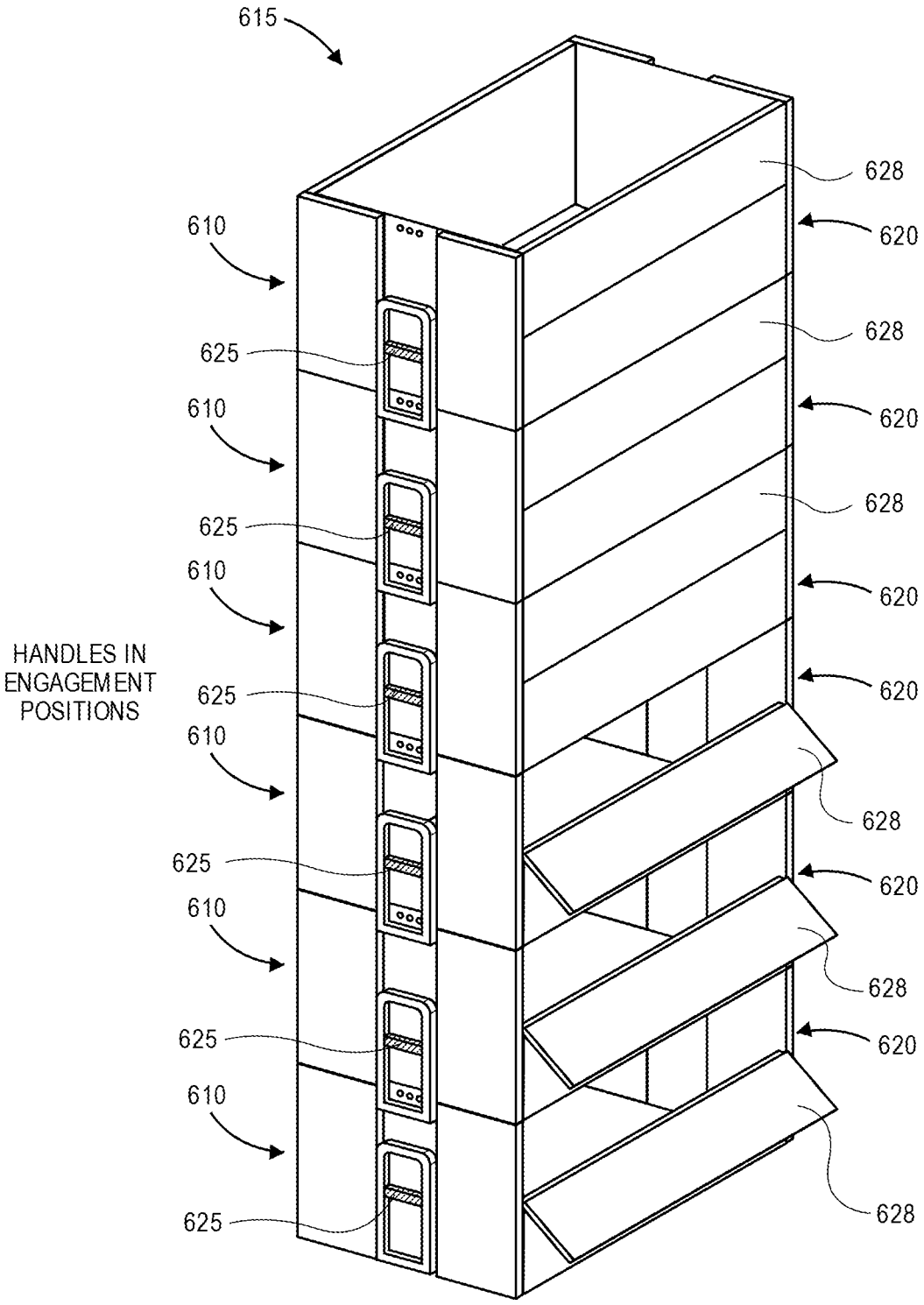

Modular containers of the present disclosure may also include extendible and/or retractable handles that are integrated into their frames or structures and may be used to transport the modular containers or to enable the modular containers to engage with one or more other containers or systems. Referring to FIGS. 6A through 6C, views of aspects of one modular container in accordance with embodiments of the present disclosure are shown. Except where otherwise noted, reference numerals preceded by the number "6" in FIGS. 6A through 6C refer to elements that are similar to elements having reference numerals preceded by the number "5" in FIGS. 5A and 5B, by the number "4" in FIGS. 4A through 4E, by the number "3" in FIGS. 3A through 3E, by the number "2" in FIGS. 2A and 2B or by the number "1" shown in FIGS. 1A through 1E.

As is shown in FIG. 6A, a container 610 includes a body 620 having a pair of long sides 622, a pair of short sides 624 and a bottom 640, and defines a cavity into which one or more items may be deposited. Each of the long sides 622 includes a foldable panel 628 joined at a hinge running parallel to upper edges and lower edges of the body 620, such as is discussed above with regard to the container 510 of FIGS. 5A and 5B. The hinges of the long sides 622 enable the foldable panels 628 to be folded and/or rotated in one or more directions with respect to the body 620, in order to provide access to the container 610 to the container laterally, e.g., through an opening on a side of the body 620 defined by the foldable panel 628, as well as vertically, e.g., from above. Additionally, each of the short sides 624 includes a handle 625 that is provided in a vertically aligned slot or channel and may be extended above an upper edge of the container 610 or retracted below a lower edge of the container 610, as necessary.

For example, as is shown in FIG. 6A, the handles 625 are in neutral positions with respect to the short sides 624 and the container 610 formed thereby. As is shown in FIG. 6B, however, the handles 625 may be extended into a carrying position where portions of the handles 625 may be engaged by one or more workers or machines, in order to manipulate or transport the container 610 between two or more locations. The slots or channels of the short sides 624 may further include one or more detents or other features for causing the handles 625 to remain therein in one or more desired positions.

As is shown in FIG. 6C, when two or more of the containers 610 are coupled in a stack (or column) 615, the handles 625 may be retracted into an engaged position where the handles 625 of one of the containers 610 may engage with another of the containers 610 in the stack 615. Moreover, as is shown in FIG. 6C, with the containers 610 aligned in the stack 615, the foldable panels 628 on the long sides 622 of one or more of the containers 610 may be manipulated and/or folded in one or more directions to enable the containers 610 to be accessed in a lateral fashion. With the handles 625 in the engaged positions as shown in FIG. 6C, the handles 625 of one container 610 are engaged with another container 610 below, and the handles 625 of the container 610 extend beyond detents within the slots or channels of the other container 610.

Although the handles 625 shown in FIGS. 6A through 6C are provided on short sides 624 of the body 620, and hinges are provided in the long sides 622 of the body 620, those of ordinary skill in the pertinent arts will recognize that extendible or retractable handles and hinges may be provided in short sides and/or long sides of a modular container in accordance with the present disclosure.

Modular containers of the present disclosure may also include one or more surfaces that may be repositioned with respect to the container bodies and used to couple the containers to one another. Referring to FIGS. 7A through 7F, views of aspects of one modular container in accordance with embodiments of the present disclosure are shown. Except where otherwise noted, reference numerals preceded by the number "7" in FIGS. 7A through 7F refer to elements that are similar to elements having reference numerals preceded by the number "6" in FIGS. 6A through 6C, by the number "5" in FIGS. 5A and 5B, by the number "4" in FIGS. 4A through 4E, by the number "3" in FIGS. 3A through 3E, by the number "2" in FIGS. 2A and 2B or by the number "1" shown in FIGS. 1A through 1E.

Figures 7A, 7B, 7C:
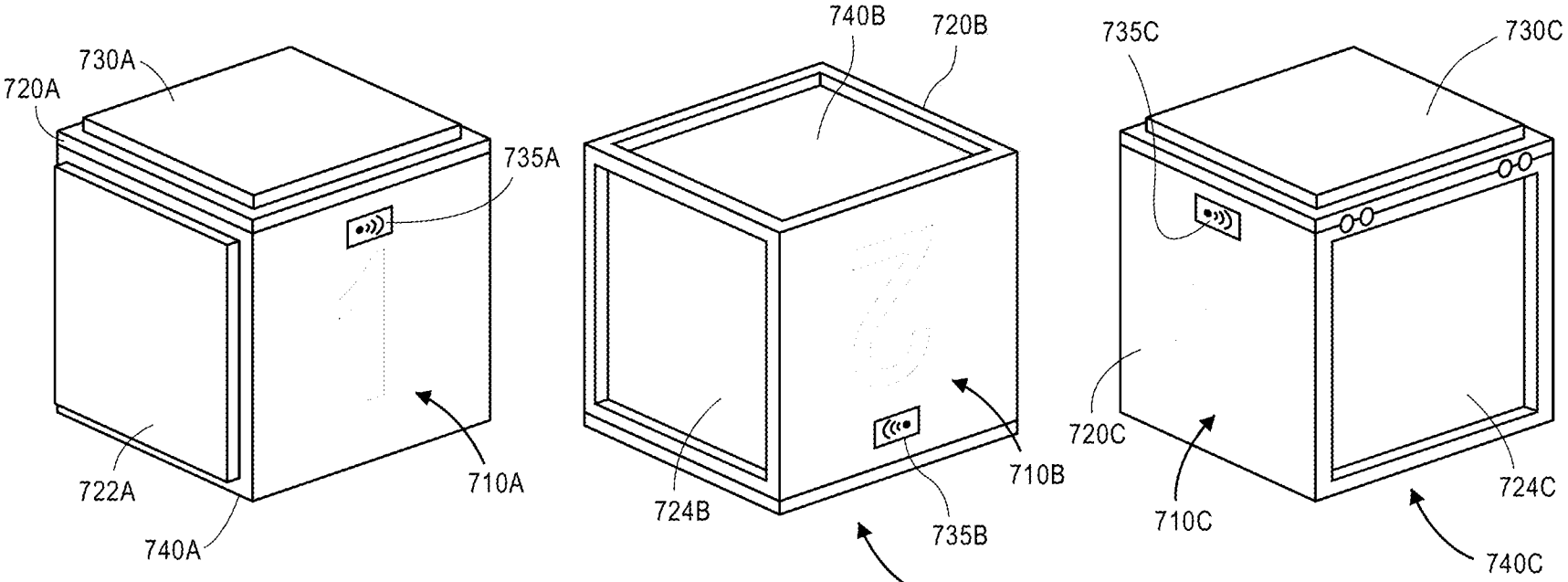

As is shown in FIGS. 7A through 7C, a plurality of containers 710A, 710B, 710C are shown. Each of the containers 710A, 710B, 710C is defined by a body 720A, 720B, 720C having a cover 730A, 730B, 730C and a base 740A, 740B, 740C. As is shown in a top view of the container 710A of FIG. 7A or a side view of the container 710C of FIG. 7C, the bodies 720A, 720C include raised outer surfaces 722A, 722C. As is shown in a bottom view of the container 710B of FIG. 7B or the side view of the container 710C of FIG. 7C, the bodies 720B, 720C further include depressed outer cavities 724B, 724C in outer surfaces of the containers 710B, 710C. The raised outer surfaces 722A, 722C shown in FIGS. 7A and 7C have one or more outer dimensions (e.g., widths, lengths, heights, cross-sectional areas) that correspond to one or more inner dimensions of the depressed outer cavities 724B, 724C shown in FIGS. 7B and 7C, thereby enabling each of the raised outer surfaces 722A, 722C of one of the containers 710A, 710C to mate with, e.g., by an interference fit, one of the depressed outer cavities 724B, 724C of another of the containers 710B, 710C.

Each of the containers 710A, 710B, 710C further includes a communications device 735A, 735B, 735C that may be configured to communicate with (e.g., transmit information or data to, or receive information or data from) one or more external computer devices or systems according to one or more wireless protocols or standards, such as by transmitting or receiving information or data regarding the contents of the containers 710A, 710B, 710C to one or more external computer devices or systems regarding the contents of the containers 710A, 710B, 710C. The covers 730A, 730B, 730C are joined to the bodies 720A, 720B, 720C by hinges that enable the covers 730A, 730B, 730C to be rotated about the bodies 720A, 720B, 720C.

Additionally, the containers 710A, 710B, 710C may further include openings (not shown) beneath the covers 730A, 730B, 730C having dimensions corresponding to the depressed outer cavity 724, such that a raised outer surface 722A, 722B, 722C of one of the containers 710A, 710B, 710C may mate with an opening beneath one of the covers 730A, 730B, 730C of another containers 710A, 710B, 710C, e.g., by an interference fit. Moreover, undersides of the covers 730A, 730B, 730C may also include cavities beneath the covers 730A, 730B, 730C having dimensions corresponding to the raised outer surfaces 722A, 722B, 722C, such that a cover 730A, 730B, 730C of one of the containers 710A, 710B, 710C may be rotated about the hinge and coupled to a raised outer surface 722A, 722B, 722C of another of the containers 710A, 710B, 710C, such as is shown in FIGS. 7D through 7F.

Modular containers of the present disclosure having different sizes may be coupled together and aligned in stacks, which may be transported together despite their differences in size. Referring to FIGS. 8A through 8D, views of aspects of one modular container in accordance with embodiments of the present disclosure are shown. Except where otherwise noted, reference numerals preceded by the number "8" in FIGS. 8A through 8D refer to elements that are similar to elements having reference numerals preceded by the number "7" in FIGS. 7A through 7F, by the number "6" in FIGS. 6A through 6C, by the number "5" in FIGS. 5A and 5B, by the number "4" in FIGS. 4A through 4E, by the number "3" in FIGS. 3A through 3E, by the number "2" in FIGS. 2A and 2B or by the number "1" shown in FIGS. 1A through 1E.

Figure 8B:
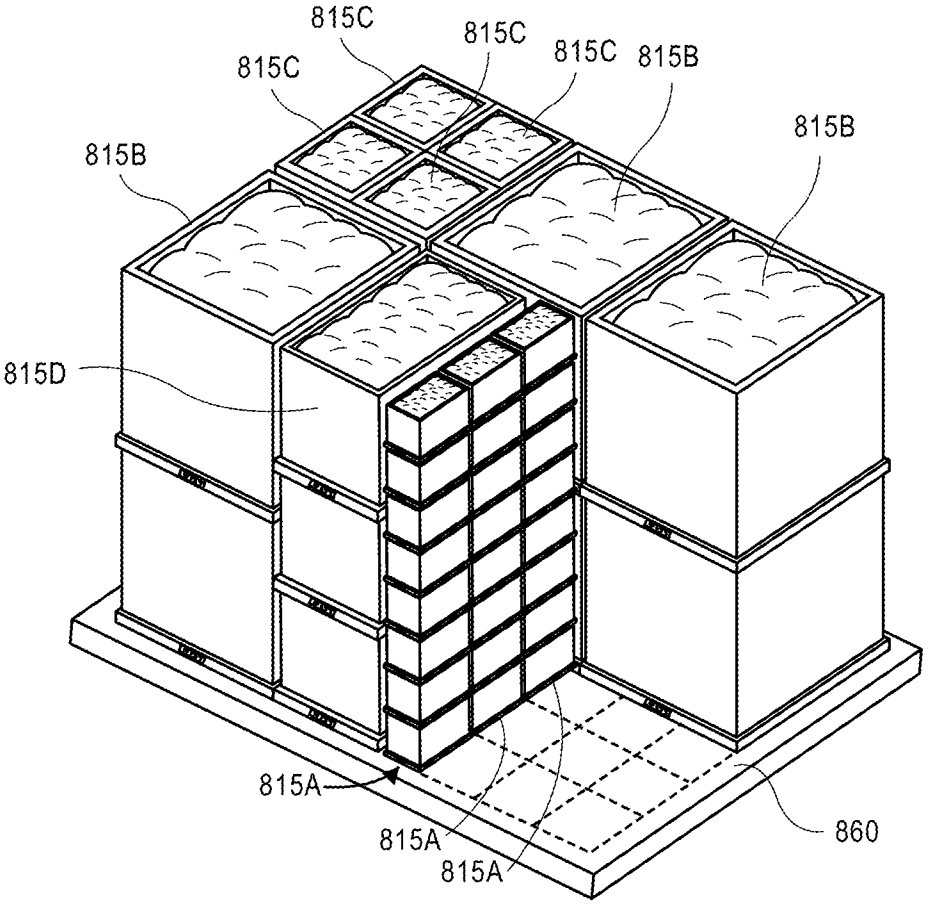
FIGS. 8A through 8D are views of aspects of one modular container in accordance with embodiments of the present disclosure.
Figure 8A:
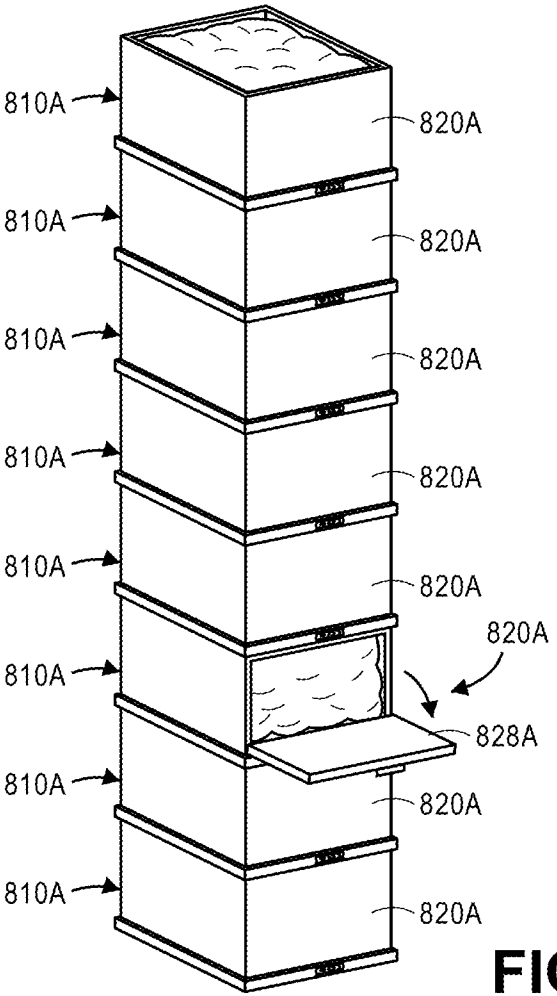

As is shown in FIG. 8A, a plurality of containers 810A of common sizes and shapes may be coupled together in a stack (or column) 815A by a series of sealing panels (or bases) 830A, which may have surfaces, ridges or ledges configured to join bodies 820A of the respective containers 810A about upper and/or lower edges. In some embodiments, one or more sides 828A of the containers 810A may be configured by hinges or other features to open, e.g., by folding, thereby enabling access to the respective containers 810A and their respective contents, e.g., when items are inserted therein or removed therefrom. In some embodiments, the sides 828A may be rotated from substantially vertical alignments or positions and substantially horizontal alignments or positions, in which the sides 828A may act as shelves or other horizontal working surfaces.

As is shown in FIG. 8B, stacks of modular containers in accordance with the present disclosure, including but not limited to the stack 815A of the containers 810A shown in FIG. 8A, may be placed on a surface 860 (e.g., a flatbed surface) with any number of other containers or stacks, which may be transported by one or more vehicles in any manner. For example, as is shown in FIG. 8B, three of the stacks 815A are coupled to or otherwise placed on the surface 860 adjacent to one another. As is also shown in FIG. 8B, three stacks 815B of containers 810B that have dimensions that are substantially larger than the dimensions of the containers 810A are also coupled or placed on the surface 860 adjacent to and forward of the stacks 815A, and also aft of the stacks 815A, at a rear edge of the surface 860. Additionally, four stacks 815C of containers 810C having dimensions that are larger than the dimensions of the containers 810A but smaller than the dimensions of the containers 810B are coupled or placed on the surface 860 aft of and alongside the stacks 815B. Additionally, between the stacks 815B and the stacks 815A, a single stack 815D of containers 810D having dimensions that are substantially larger than the dimensions of the containers 810A in the stacks 815A and substantially smaller than the dimensions of the containers 810B in the stacks 815B is coupled or placed on the surface 860.

Figure 8C:
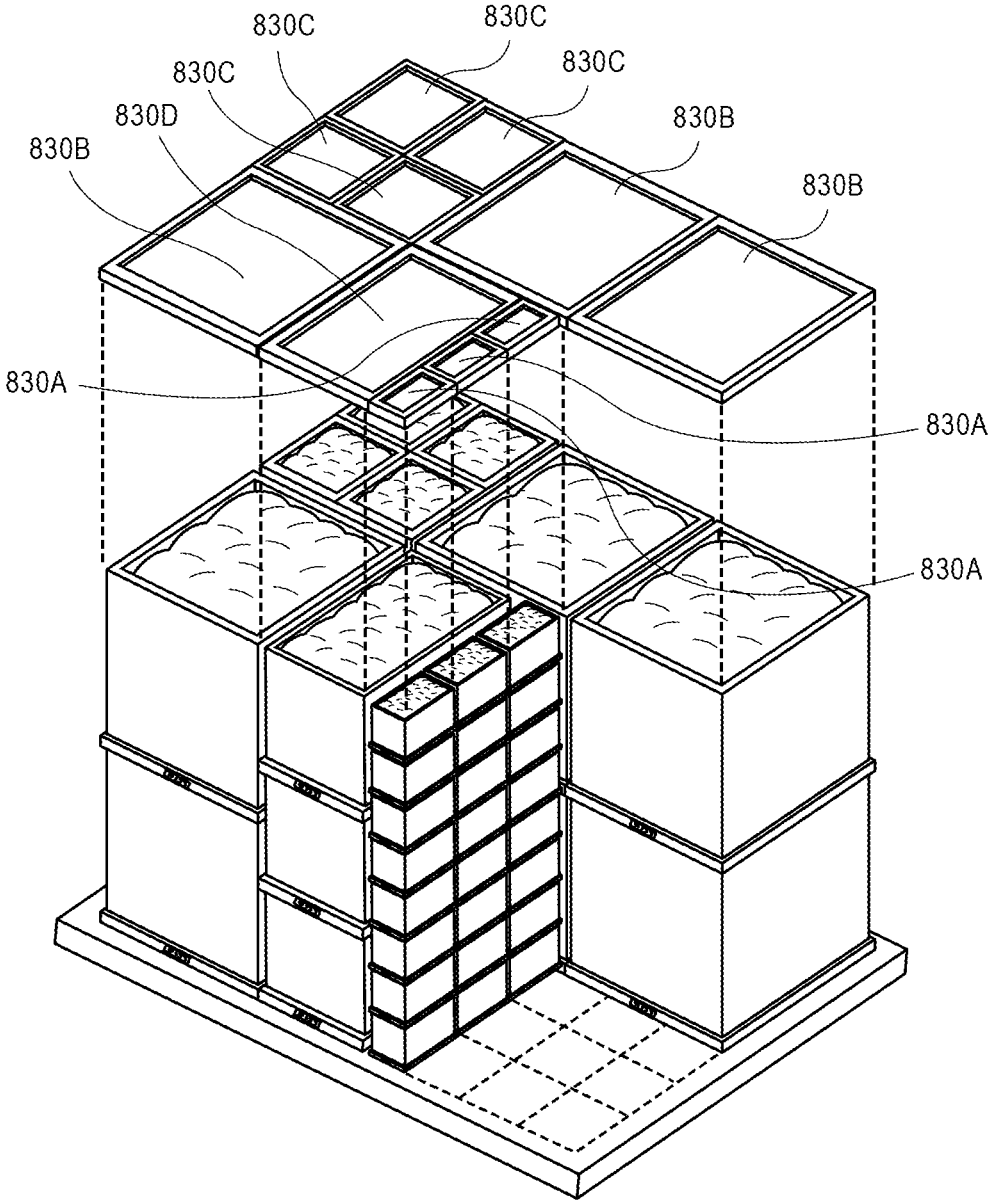
Figure 8D:
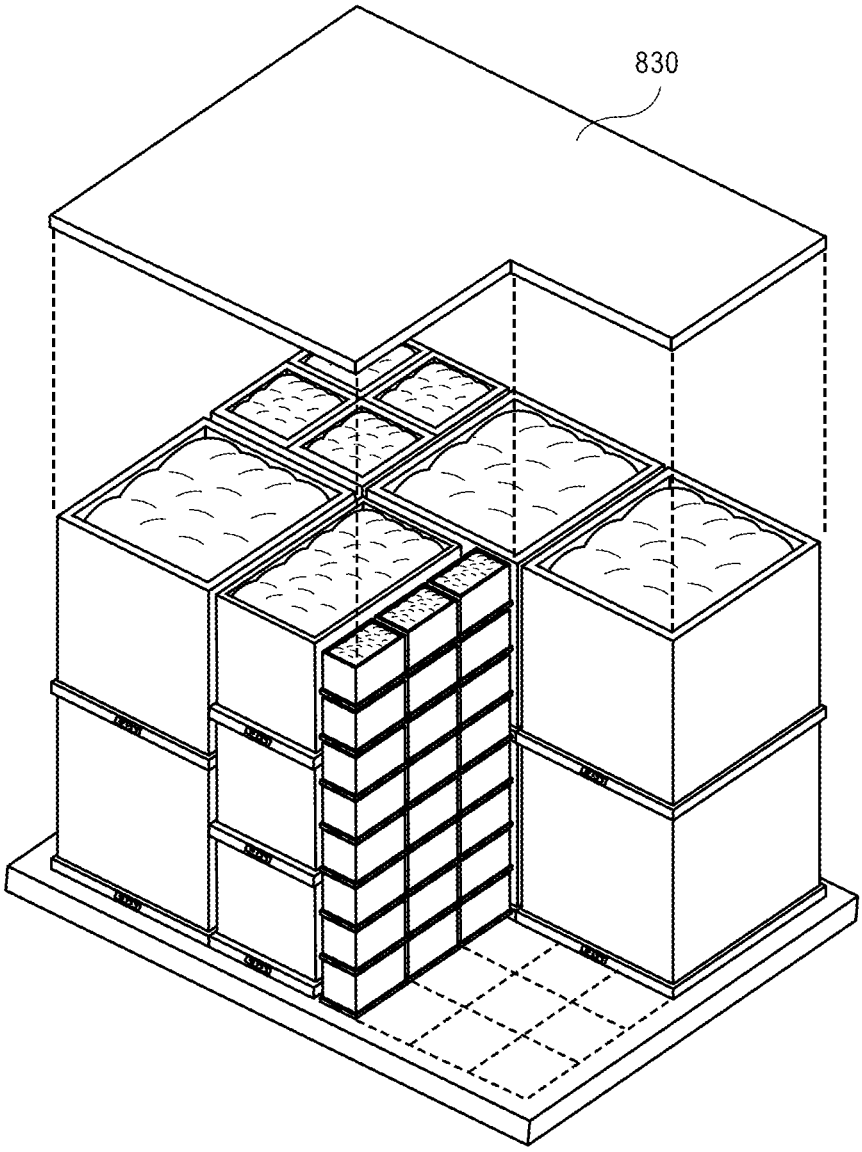

In some embodiments, the uppermost containers of the stacks 815A, 815B, 815C, 815D may be covered by one or more sealing panels (or bases). As is shown in FIG. 8C, each of the respective stacks 815A, 815B, 815C, 815D may be covered by sealing panels (or bases) 830A, 830B, 830C, 830D that are specifically designed and constructed for the respective containers atop the respective stacks 815A, 815B, 815C, 815D. As is shown in FIG. 8D, containers of multiple stacks 815A, 815B, 815C, 815D may be covered by one or more sealing panels (or bases) that are specifically designed and constructed to cover multiple containers, such as a single sealing panel (or base) 830 that is designed and constructed to cover the uppermost containers in each of the stacks 815A, as well as the uppermost containers in each of the stacks 815B, 815C, 815D.

The stacks 815A, 815B, 815C, 815D may be coupled or placed onto the surface 860 and maintained in a proper alignment thereon in any manner, e.g., by one or more physical or mechanical markings or features (e.g., grooves) within the surface 860, or by one or more magnets or sensors. Alternatively, or additionally, the surface 860 may be configured to provide guidance to one or more humans or machines who are charged with coupling or placing the stacks 815A, 815B, 815C, 815D on the surface 860, or removing the stacks 815A, 815B, 815C, 815D from the surface 860, e.g., by one or more sensors or the exchange of information or data via one or more wired or wireless means, such as Bluetooth®, RFID or NFC.

Figure 9A:
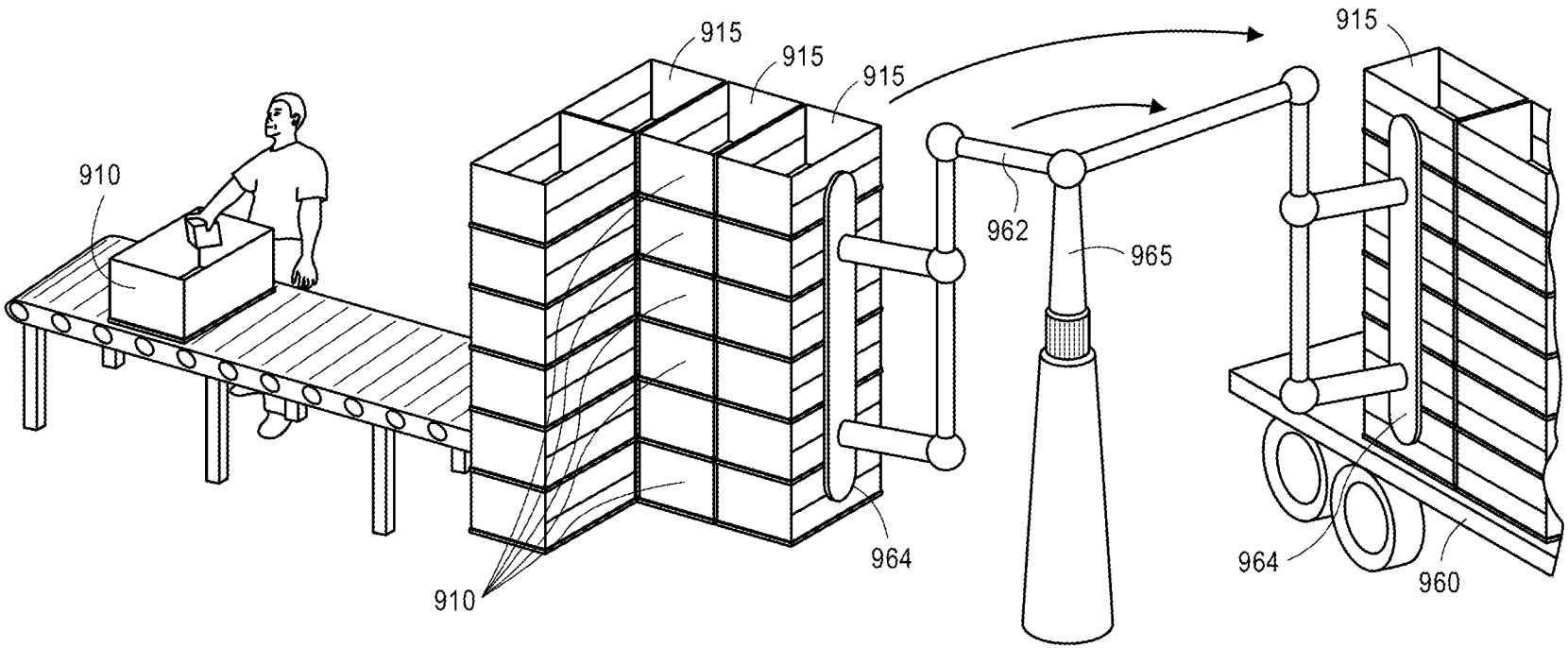
FIGS. 9A and 9B are views of aspects of one modular container in accordance with embodiments of the present disclosure.
Figure 9B:
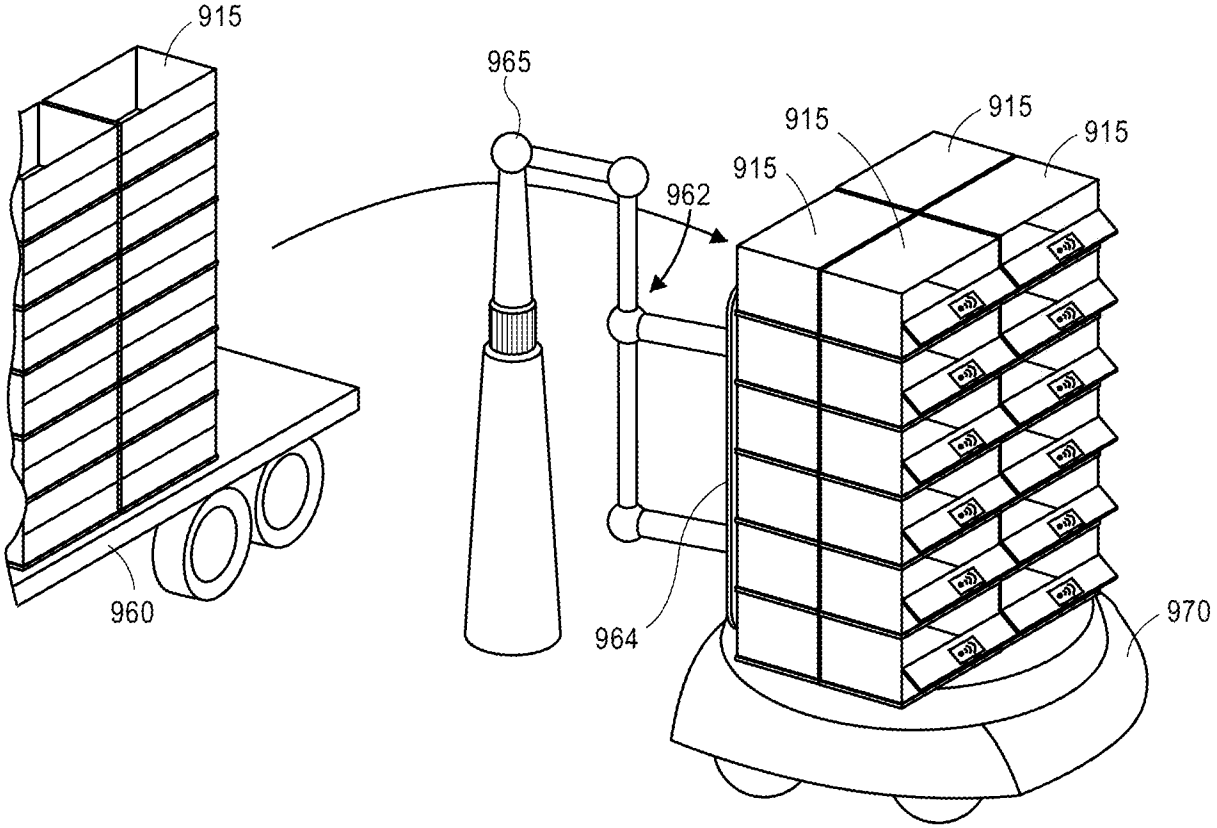

Modular containers of the present disclosure may be transported singly or in bulk, and manually or by one or more automated systems (e.g., robots). Referring to FIGS. 9A and 9B, views of aspects of one modular container in accordance with embodiments of the present disclosure are shown. Except where otherwise noted, reference numerals preceded by the number "9" in FIGS. 9A and 9B refer to elements that are similar to elements having reference numerals preceded by the number "8" in FIGS. 8A through 8D, by the number "7" in FIGS. 7A through 7F, by the number "6" in FIGS. 6A through 6C, by the number "5" in FIGS. 5A and 5B, by the number "4" in FIGS. 4A through 4E, by the number "3" in FIGS. 3A through 3E, by the number "2" in FIGS. 2A and 2B or by the number "1" shown in FIGS. 1A through 1E.

As is shown in FIG. 9A, a robotic system 965 having a robotic arm 962 with a vacuum head apparatus 964 engages a plurality of stacks (or columns) 915 of containers 910. The vacuum head apparatus 964 contacts common or co-aligned surfaces of containers 910 in one or more of the stacks 915, picks the stacks 915 from a ground surface or pallet, and deposits the stacks 915 on a surface 960 (e.g., a flatbed surface). As is shown in FIG. 9B, when the surface 960 is transported to another location, the stacks 915 may be removed by another robotic system 962 having a vacuum head apparatus 964 or other component for engaging with one or more containers or stacks. The robotic system 962 may offload one or more of the stacks 915 in their entirety, or one or more of the individual containers 910, and deposit the stacks 915 or containers 910 on an autonomous mobile robot 970 or another static or dynamic system.

Figure 10A:
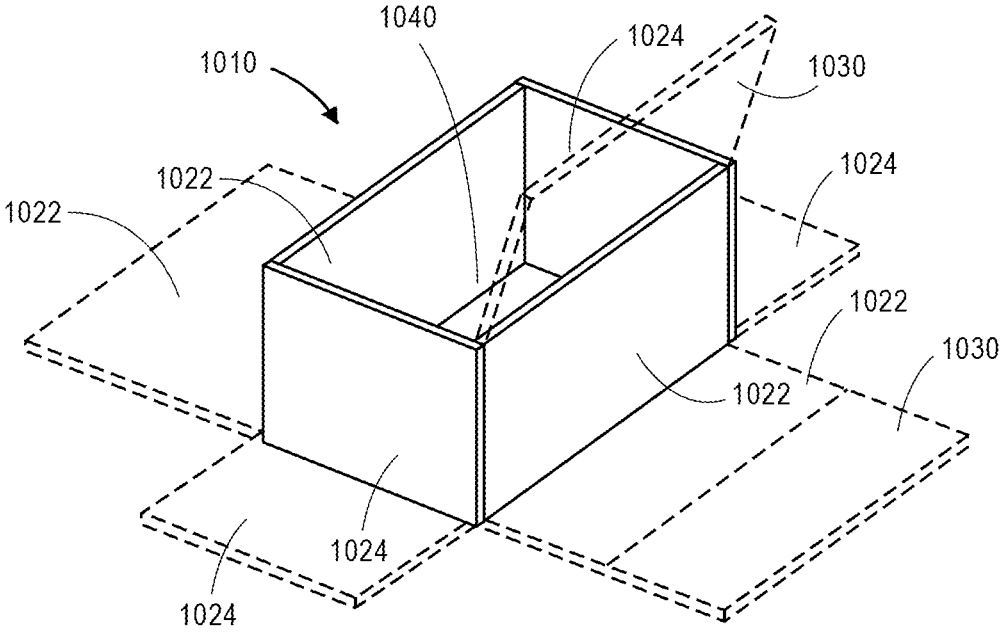
FIGS. 10A and 10B are views of aspects of one modular container in accordance with embodiments of the present disclosure.
Figure 10B:
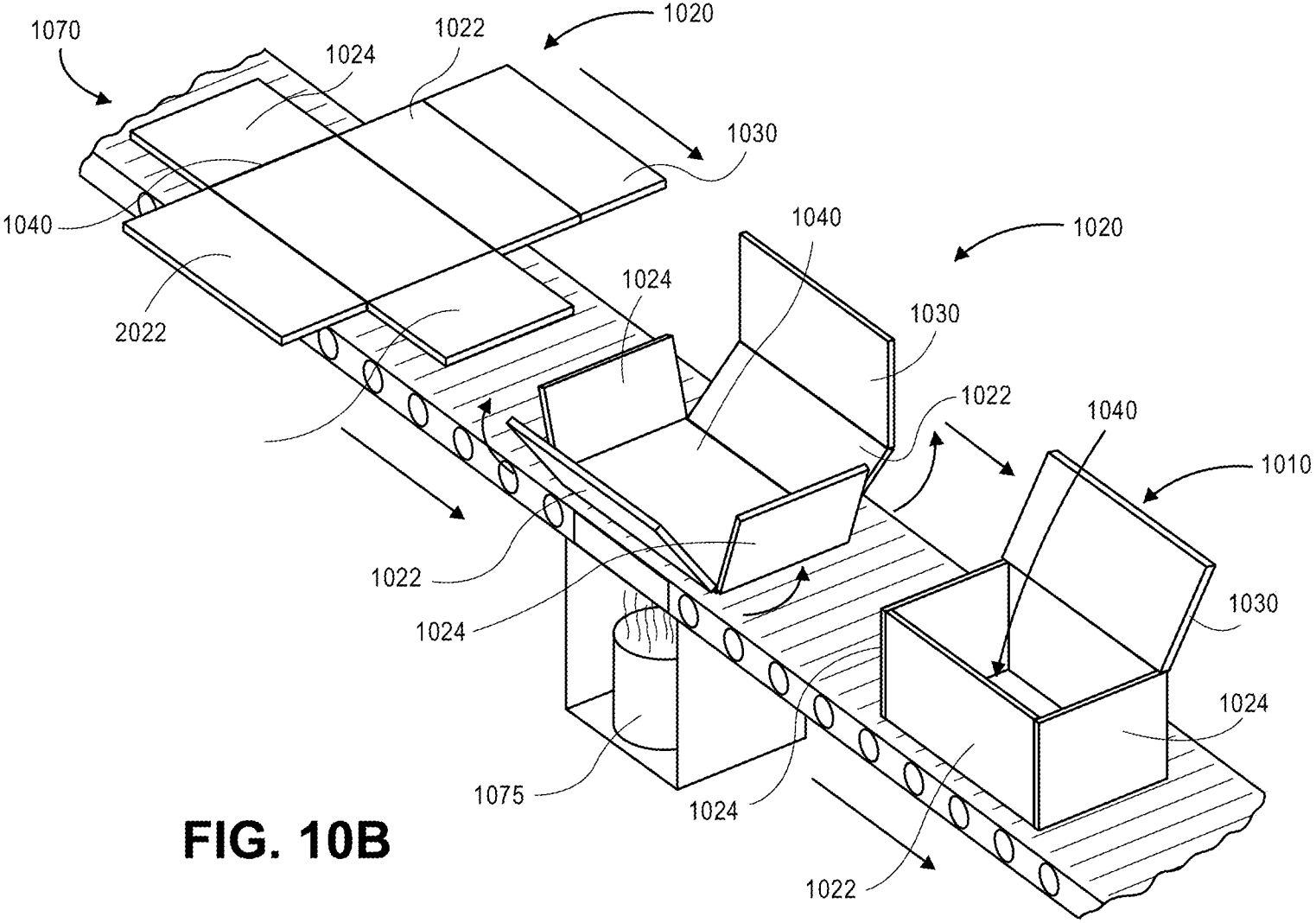

Some of the modular containers of the present disclosure may be configured to assemble themselves, e.g., from a flat series of panels or blanks into an integrated container. Referring to FIGS. 10A and 10B, views of aspects of one modular container in accordance with embodiments of the present disclosure are shown. Except where otherwise noted, reference numerals preceded by the number "10" in FIGS. 10A and 10B refer to elements that are similar to elements having reference numerals preceded by the number "9" in FIGS. 9A and 9B, by the number "8" in FIGS. 8A through 8D, by the number "7" in FIGS. 7A through 7F, by the number "6" in FIGS. 6A through 6C, by the number "5" in FIGS. 5A and 5B, by the number "4" in FIGS. 4A through 4E, by the number "3" in FIGS. 3A through 3E, by the number "2" in FIGS. 2A and 2B or by the number "1" shown in FIGS. 1A through 1E.

As is shown in FIG. 10A, a container 1010 includes a pair of long sides 1022, a pair of short sides 1024, a cover 1030 and a bottom 1040. The container 1010 is formed from a blank 1020 having the long sides 1022, the short sides 1024, the cover 1030 and the bottom 1040 as parts of a single-piece unit, with the long sides 1022 and the short sides 1024 rotatably joined to the bottom 1040 by hinges or other systems, and the cover 1030 joined to one of the long sides 1022 by a hinge or other system. For example, the long sides 1022 and the short sides 1024 may be rotatably joined to the bottom 1040 by one or more electromagnetic hinges, solenoid-actuated filament-driven walls, or any other like systems that may electronically or wirelessly cause the long sides 1022, the short sides 1024 to rotate about such hinges, and to join pairs of edges of the long sides 1022 with edges of the short sides 1024 to define the container 1010.

Although the container 1010 of FIG. 10A is shown as having a rectangular shape, e.g., with the long sides 1022 and the short sides 1024 provided at normal angles with respect to one another and the bottom 1040, those of ordinary skill in the pertinent arts will recognize that the containers 1010 may include sides aligned at any angle with respect to one another. For example, in some embodiments, the container 1010 may have a frustopyramidal shape, and the long sides 1022 and the short sides 1024 may be provided at non-normal angles with respect to one another and the bottom 1040.

The container 1010 may be formed from the blank 1020 in any manner, even while the blank 1020 is in motion, e.g., on a conveying system 1070 having an activation system 1075 disposed beneath the conveying system 1070 at a selected location. As is shown in FIG. 10B, as the blank

1020 approaches the location of the activation system 1075, the activation system 1075 may be energized, e.g., by wired or wireless means, to cause the electromagnetic hinges or solenoid-actuated filament-driven walls of the blank 1020 to be vertically drawn upward and toward another, and to define the container 1010 having a cavity for receiving items therein. Subsequently, after one or more items are placed into the formed container 1010, the cover 1030 may be sealed thereon manually or by further activating one or more electromagnetic hinges.

Although some embodiments of the present disclosure describe the fabrication or use of containers and the packaging of items in such cavities within a fulfillment center environment, those of ordinary skill in the pertinent arts will recognize that the systems and methods of the present disclosure may be utilized to fabricate and use containers for any purpose and are not limited to use in fulfillment centers. Rather, the systems and methods of the present disclosure may be utilized in connection with the fabrication and use of containers for any reason, which may be customized based on any information or data regarding an item that may be known, determined or predicted. Furthermore, those of ordinary skill in the pertinent arts will recognize that aspects or features of any of the embodiments disclosed or described herein may be incorporated into aspects or features of any of the other embodiments disclosed or described herein. For example, in some embodiments, the handles 625 provided in the slots or channels of the short sides 624 of the containers 610 shown in FIGS. 6A through 6C may be provided in sides of other types or forms of containers, such as the hinged short sides 524 of the containers 510 shown in FIGS. 5A and 5B. Moreover, in some embodiments, a container may include two or more of the features disclosed herein. For example, referring again to FIG. 5A, one of the short sides 524 may include a slot or other opening for receiving one or more fingers of a hand therein, and another of the short sides 524 may include one or more of the handles 625 provided in an external slot or channel.

Alternatively, those of ordinary skill in the pertinent arts will further recognize that where one or more of the embodiments disclosed herein are shown or described as including two of an aspect or feature, e.g., panels, hinges, handles or surfaces, an embodiment of the present disclosure may include a single one of the aspect or feature, three or more of the aspect or feature, or need not include any of the aspect or feature in accordance with the present disclosure.

It should be understood that, unless otherwise explicitly or implicitly indicated herein, any of the features, characteristics, alternatives or modifications described regarding a particular embodiment herein may also be applied, used, or incorporated with any other embodiment described herein, and that the drawings and detailed description of the present disclosure are intended to cover all modifications, equivalents and alternatives to the various embodiments as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Additionally, it should be appreciated that the detailed description is set forth with reference to the accompanying drawings, which are not drawn to scale. In the drawings, the use of the same or similar reference numbers in different figures indicates the same or similar items or features. Except where otherwise noted, left-most digit(s) of a reference number identify a figure in which the reference number first appears, while two right-most digits of a reference number in a figure indicate a component or a feature that is similar to components or features having reference numbers with the same two right-most digits in other figures.

Conditional language, such as, among others, "can," "could," "might," or "may," unless specifically stated otherwise, or otherwise understood within the context as used, is generally intended to convey in a permissive manner that certain embodiments could include, or have the potential to include, but do not mandate or require, certain features, elements and/or steps. In a similar manner, terms such as "include," "including" and "includes" are generally intended to mean "including, but not limited to." Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

The elements of a method, process, or algorithm described in connection with the embodiments disclosed herein can be embodied directly in hardware, in a software module stored in one or more memory devices and executed by one or more processors, or in a combination of the two. A software module can reside in RAM, flash memory, ROM, EPROM, EEPROM, registers, a hard disk, a removable disk, a CD-ROM, a DVD-ROM or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC. The ASIC can reside in a user terminal. In the alternative, the processor and the storage medium can reside as discrete components in a user terminal.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative embodiments thereof, the foregoing and various other additions and omissions may be made therein and thereto without departing from the spirit and scope of the present disclosure.

What is claimed is:

1. A first collapsible container comprising:

a first upper frame member having a first shape and a first cross-sectional area, wherein the first upper frame member comprises a first opening, a first hinge and a first lid, wherein the first lid is configured to rotate about the first hinge between a first closed position in contact with the first opening and at least a first open position not in contact with the first opening;

a first lower frame member having the first shape and the first cross-sectional area;

a first flexible body having a first upper edge joined to the first upper frame member and a first lower edge coupled to the first lower frame member, a first outer surface and a first inner surface, wherein the first upper frame member, the first lower frame member and the first inner surface of the first flexible body define a first cavity for accommodating one or more items;

a first valve provided within the first lower frame member, wherein the first valve extends through the first lower frame member between an exterior of the first collapsible container and the first cavity; and a second valve provided within the first upper frame member, wherein the second valve extends through the first upper frame member between the exterior of the first collapsible container and the cavity, wherein the first valve is configured to mate with the second valve, and wherein the first cavity is maintained at a positive pressure with respect to atmospheric pressure with the first lid in the first closed position.

2. The first collapsible container of claim 1, wherein the first flexible body is formed from a canvas, a rubber, a woven fabric, a non-woven fabric, a natural leather, or a synthetic leather, and wherein each of the first upper frame member and the first lower frame member is formed from a metal, a wood, a composite, a rubber or a plastic.

3. The first collapsible container of claim 1, further comprising a communications device coupled to one of the first upper frame member or the first lower frame member, wherein the communications device is configured to transmit and receive data according to one or more of a Bluetooth protocol, a Wireless Fidelity protocol, a radiofrequency identification protocol or a near field communications protocol.

4. The first collapsible container of claim 1, wherein the first shape is a rectangle.

5. The first collapsible container of claim 1, wherein an external surface of at least one of the first upper frame member, the first lid, or the first flexible body comprises at least one marking thereon, and wherein the at least one marking comprises one of an alphanumeric character, a symbol, a one-dimensional bar code or a two-dimensional bar code provided thereon.

6. The first collapsible container of claim 1, wherein the first flexible body has a first height when the first cavity is maintained at a first positive pressure with respect to the atmospheric pressure with the first lid in the first closed position, and wherein the first flexible height has a second height when the first cavity is maintained at a second positive pressure with respect to the atmospheric pressure with the first lid in the first closed position.

7. A system comprising a first collapsible container and a second collapsible container, wherein the first collapsible container comprises:

a first upper frame member having a first shape and a first cross-sectional area, wherein the first upper frame member comprises a first opening, a first lid and a first hinge, and wherein the first lid is configured to rotate about the first hinge between a first closed position in contact with the first opening and at least a first open position not in contact with the first opening;

a first lower frame member having the first shape and the first cross-sectional area, wherein the first lower frame member is coupled to a second upper frame member of the second collapsible container;

a first flexible body having a first upper edge joined to the first upper frame member and a first lower edge coupled to the first lower frame member, a first outer surface and a first inner surface, wherein the first upper frame member, the first lower frame member and the first inner surface of the first flexible body define a first cavity for accommodating one or more items; and a first valve provided within the first lower frame member, wherein the first valve extends through the first lower frame member between an exterior of the first collapsible container and the first cavity, wherein the first cavity is maintained at a positive pressure with respect to atmospheric pressure with the first lid in the first closed position, and wherein the second collapsible container comprises:

the second upper frame member, wherein the second upper frame member has the first shape and the first cross-sectional area, wherein the second upper frame member comprises a second opening, a second hinge and a second lid, wherein the second lid comprises a second valve extending through the first upper frame member between the exterior of the first collapsible container and the cavity, and wherein the second lid is configured to rotate about the second hinge between a second closed position in contact with the second opening and at least a second open position not in contact with the second opening;

a second lower frame member having the first shape and the first cross-sectional area; and a second flexible body having a second upper edge joined to the second upper frame member and a second lower edge coupled to the second lower frame member, a second outer surface and a second inner surface, wherein the second upper frame member, the second lower frame member and the second inner surface of the second flexible body define a second cavity for accommodating one or more items, wherein the second valve is mated with the first valve, and wherein the first cavity is in fluid communication with the second cavity by way of the first valve and the second valve.

8. The system of claim 7, wherein the first flexible body is formed from a canvas, a rubber, a woven fabric, a non-woven fabric, a natural leather, or a synthetic leather, and wherein each of the first upper frame member and the first lower frame member is formed from a metal, a wood, a composite, a rubber or a plastic.

9. The system of claim 7, further comprising a communications device coupled to one of the first upper frame member, the first lower frame member, the second upper frame member, or the second lower frame member, wherein the communications device is configured to transmit and receive data according to one or more of a Bluetooth protocol, a Wireless Fidelity protocol, a radiofrequency identification protocol or a near field communications protocol.

10. The system of claim 7, wherein the first flexible body has a first height when the first cavity is maintained at a first positive pressure with respect to the atmospheric pressure with the first lid in the first closed position, and wherein the first flexible height has a second height when the first cavity is maintained at a second positive pressure with respect to the atmospheric pressure with the first lid in the first closed position.

11. The system of claim 7, wherein the first shape is a rectangle.

12. A method for storing items within a first collapsible container, wherein the first collapsible container comprises:

a first upper frame member having a first shape and a first cross-sectional area, wherein the first upper frame member comprises a first opening and a first lid coupled to the first upper frame member by a first hinge, and wherein the first lid is configured to rotate about the first hinge between a first closed position in contact with the first opening and at least a first open position not in contact with the first opening;

a first lower frame member having the first shape and the first cross-sectional area;

a first flexible body having a first upper edge joined to the first upper frame member and a first lower edge coupled to the first lower frame member, a first outer surface and a first inner surface, wherein the first upper frame member, the first lower frame member and the first inner surface of the first flexible body define a first cavity for accommodating one or more items; and a first valve provided within the first lower frame member, wherein the first valve extends through the first lower frame member between an exterior of the first collapsible container and the first cavity, wherein the first cavity is maintained at a positive pressure with respect to atmospheric pressure with the first lid in the first closed position, and wherein the method comprises:

causing the first lid to be placed in the first open position;

with the first lid in the first open position, inserting at least one item into the first cavity by way of the first opening;

causing the first lid to be placed in the first closed position; and selecting an internal height of the first cavity based at least in part on at least one dimension of the at least one item;

determining a first volume of air based at least in part on the internal height; and with the first lid in the first closed position, charging at least the first volume of air into the first cavity by way of the first valve.

13. The method of claim 12, wherein the first flexible body is formed from a canvas, a rubber, a woven fabric, a non-woven fabric, a natural leather, or a synthetic leather, and wherein each of the first upper frame member and the first lower frame member is formed from a metal, a wood, a composite, a rubber or a plastic.

14. The method of claim 12, wherein the first collapsible container further comprises a communications device coupled to one of the first upper frame member or the first lower frame member, and wherein the communications device is configured to transmit and receive data according to one or more of a Bluetooth protocol, a Wireless Fidelity protocol, a radiofrequency identification protocol or a near field communications protocol.

15. The method of claim 12, wherein an external surface of at least one of the first upper frame member, the first lid, or the first flexible body comprises at least one marking thereon, and wherein the at least one marking comprises one of an alphanumeric character, a symbol, a one-dimensional bar code or a two-dimensional bar code provided thereon.

16. The method of claim 12, further comprising:

causing the second lid to be placed in the first open position; and removing the at least one item from the first cavity by way of the first opening.

17. The method of claim 12, wherein the first collapsible container is coupled to a second collapsible container comprising:

a second upper frame member coupled to the first lower frame member, wherein the second upper frame member has the first shape and the first cross-sectional area, wherein the second upper frame member comprises a second opening, a second hinge and a second lid, wherein the second lid comprises a second valve extending through the first upper frame member between the exterior of the first collapsible container and the cavity, and wherein the second lid is configured to rotate about the second hinge between a second closed position in contact with the second opening and at least a second open position not in contact with the second opening;

a second lower frame member having the first shape and the first cross-sectional area; and a second flexible body having a second upper edge joined to the second upper frame member and a second lower edge coupled to the second lower frame member, a second outer surface and a second inner surface, wherein the second upper frame member, the second lower frame member and the second inner surface of the second flexible body define a second cavity for accommodating one or more items, wherein the second valve is mated with the first valve, and wherein the first cavity is in fluid communication with the second cavity by way of the first valve and the second valve.

18. The method of claim 12, wherein the first shape is a rectangle.

* * * * *